US012366139B2

(12) United States Patent
Aung et al.

(10) Patent No.: US 12,366,139 B2
(45) Date of Patent: Jul. 22, 2025

(54) SYSTEMS AND METHODS FOR DELIVERING DEGRADABLE POLYESTER DURING GRAVEL PACKING

(71) Applicant: Schlumberger Technology Corporation, Sugar Land, TX (US)

(72) Inventors: Tint Htoo Aung, Houston, TX (US); Cedric Manzoleloua, Houston, TX (US); Balkrishna Gadiyar, Katy, TX (US); Edward Derkach, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/549,981

(22) PCT Filed: Mar. 9, 2022

(86) PCT No.: PCT/US2022/071046
§ 371 (c)(1),
(2) Date: Sep. 11, 2023

(87) PCT Pub. No.: WO2022/192880
PCT Pub. Date: Sep. 15, 2022

(65) Prior Publication Data

US 2024/0151121 A1 May 9, 2024

Related U.S. Application Data

(60) Provisional application No. 63/201,759, filed on May 12, 2021, provisional application No. 63/159,273, filed on Mar. 10, 2021.

(51) Int. Cl.
*E21B 43/04* (2006.01)
*E21B 37/06* (2006.01)

(52) U.S. Cl.
CPC ..... *E21B 43/04* (2013.01); *E21B 37/06* (2013.01)

(58) Field of Classification Search
CPC .... C09K 8/805; C09K 2208/26; C09K 8/508; C09K 8/5751; C09K 8/62; C09K 8/68;
(Continued)

(56) References Cited

U.S. PATENT DOCUMENTS

2004/0147404 A1 7/2004 Thaemlitz et al.
2005/0034865 A1 2/2005 Todd et al.
(Continued)

FOREIGN PATENT DOCUMENTS

CA 2772108 A1 * 3/2011 ..... C09K 8/12
CA 2803232 A1 * 1/2012 ..... C09K 8/80
(Continued)

OTHER PUBLICATIONS

International Search Report and Written Opinion issued in International Patent application PCT/US2022/071046 dated Jun. 27, 2022, 13 pages.

*Primary Examiner* — Zakiya W Bates
(74) *Attorney, Agent, or Firm* — Jeffrey D. Frantz

(57) ABSTRACT

Systems and methods deliver degradable polyester during gravel packing and may include a gravel pack system disposed within a wellbore formed in a subterranean formation. The systems and methods may include drilling at least one interval of a wellbore with a non-aqueous wellbore fluid, wherein the non-aqueous wellbore fluid produces a filter cake in the at least one interval of the wellbore and gravel packing an interval of a wellbore traversing a subterranean formation with a gravel pack that comprises non-aqueous gravel pack carrier fluid and proppants. The systems and methods may also include hydrolyzing degradable polyester
(Continued)

that is associated with the gravel pack and degrading at least one portion of the filter cake.

20 Claims, 17 Drawing Sheets

(58) Field of Classification Search
CPC .... C09K 8/64; C09K 8/36; C09K 8/32; E21B 43/04; E21B 37/06; E21B 43/025; E21B 43/261; E21B 43/267; E21B 33/13; E21B 37/00; E21B 43/26
See application file for complete search history.

(56) References Cited

U.S. PATENT DOCUMENTS

| | | | | |
|---|---|---|---|---|
| 2006/0205608 | A1 | 9/2006 | Todd | |
| 2006/0223715 | A1 | 10/2006 | Svoboda et al. | |
| 2007/0032386 | A1* | 2/2007 | Abad | C09K 8/508 507/201 |
| 2010/0212896 | A1 | 8/2010 | Navarro et al. | |

FOREIGN PATENT DOCUMENTS

| | | | | |
|---|---|---|---|---|
| CA | 2868331 | A1 * | 11/2012 | C09K 8/516 |
| WO | WO-2005085595 | A1 * | 9/2005 | C09K 8/508 |

* cited by examiner

| Time (hrs) | pH |
|---|---|
| 0 | 7.3 |
| 2 | 3.0 |
| 4 | 2.6 |
| 8 | 2.3 |
| 16 | 2.2 |
| 24 | 2.2 |
| 48 | 2.2 |

| Exposure Time (mins) | 0 | 30 | 60 | 180 |
|---|---|---|---|---|
| ES @ 230°F | 440 | 375 | 358 | 240 |
| ES @ 285°F | 440 | 330 | 330 | 2 |

| Exposure Time (mins) | 0 | 30 | 60 | 180 | 300 |
|---|---|---|---|---|---|
| ES @ 230°F | 408 | 380 | 390 | 230 | 2 |
| ES @ 285°F | 408 | 390 | 395 | 3 | 2 |

SYSTEMS AND METHODS FOR DELIVERING DEGRADABLE POLYESTER DURING GRAVEL PACKING

CROSS-REFERENCE TO RELATED APPLICATIONS

This application is a National Stage Entry of International Application No. PCT/US2022/071046, filed on Mar. 9, 2022, which is related to U.S. Patent Application No. 63/201,759 filed on May 12, 2021, and U.S. Patent Application No. 63/159,273 filed on Mar. 10, 2021 which are herein incorporated by reference in its entirety.

FIELD OF THE DISCLOSURE

The present disclosure is generally directed to systems and methods for delivering degradable polyester during one or more gravel packing operations to enhance performances of one or more completion applications.

BACKGROUND

It is generally known that wellbores are first drilled through subterranean formations to produce oil and gas from hydrocarbon reservoirs. Wellbores drilled in certain subterranean formations are sometimes completed as open holes, i.e., without a casing or liner installed therein. Special drilling fluids referred to in the art as "drill-in fluids" may be used to drill such wellbores to minimize damage to the permeability of producing zones of the subterranean formations. The drill-in fluids may form filter cakes on walls of the wellbores, which may prevent or reduce fluid loss during drilling, and upon completion of the drilling, may stabilize the wellbores during subsequent completion operations such as placing gravel packs in the wellbores. Moreover, after gravel pack emplacements, the filter cakes existing between the gravel pack sands and the subterranean formations may require removal before the flow of hydrocarbons may be initiated. Without the removal of the filter cakes, plugging of the production screens and gravel pack by the filter cakes may occur which may substantially impair production of the wellbores.

After completion operations in the wellbores have been concluded, removal of the filter cakes remaining on the walls of the wellbores is necessary. Aqueous acid solutions or breaker fluids typically contact the filter cakes to degrade and/or remove the filter cakes from the walls rates.

Open-hole gravel-pack operations are traditionally executed using water-based carrier fluids even when the wellbores or reservoirs are drilled with non-aqueous drilling fluids due to reactive shale breaks within the subterranean formations. The use of shale inhibitors may achieve successful gravel pack emplacements unless the shales are extremely sensitive. However, risks of shale dispersion and collapse often remain or still exists, which poses serious impairments to the production in the lives of the wellbores. In addition, transitioning the wellbores from non-aqueous drilling fluids to pre-gravel pack states typically involve utilizing multiple fluids and costly rig downtime. To eliminate the associated risks and costly rig downtime, modified gravel pack carrier fluids were introduced a few years ago; however, these modified gravel pack carrier fluids are traditionally not compatible with post gravel pack filter cake breaker fluids and often hinder or prevent successful filter cake removal from the walls of the wellbores disposed within the subterranean formations.

SUMMARY OF THE DISCLOSURE

This summary is provided to introduce a selection of concepts that are further described below in the detailed description. This summary is not intended to identify key or essential features of the claimed subject matter, nor is it intended to be used as an aid in limiting the scope of the claimed subject matter.

In one or more embodiments, a method for delivering degradable polyester during gravel packing downhole is provided. The method may comprise drilling at least one interval of a wellbore with a non-aqueous wellbore fluid, wherein the non-aqueous wellbore fluid produces a filter cake in the at least one interval of the wellbore and gravel packing an interval of a wellbore traversing a subterranean formation with a gravel pack that comprises non-aqueous gravel pack carrier fluid and proppants. The method may also comprise hydrolyzing degradable polyester that is associated with the gravel pack and degrading at least one portion of the filter cake.

In an embodiment, the method may further comprise introducing a filter cake breaker fluid system into the interval of the wellbore traversing the subterranean formation, wherein the filter cake breaker fluid system comprises the degradable polyester.

In an embodiment, the method may further comprise adding sized degradable polyester particles to the gravel pack prior to the interval of the wellbore traversing the subterranean formation being gravel packed, wherein the sized degradable polyester particles comprise the degradable polyester.

In an embodiment, at least a portion of the proppants is infused or coated with the degradable polyester.

In an embodiment, the non-aqueous gravel pack carrier fluid is a reversible invert emulsion fluid.

In an embodiment, an organic acid releasable from the degradable polyester hydrolyzes and decreases the pH of the gravel pack to a pH value that is less than about 5 or that ranges from about 1 to about 5, from about 1.5 to about 4, or from about 2 to about 3.

In an embodiment, an organic acid releasable from the degradable polyester comprises at least one acid selected from polylactic acid, polyglycolic acid, polylactic-co-glycolic acid, polymalic acid, polygluconic acid, poly citric acid, poly mandelic acid, polysaccharide acid, poly mucic acid, and poly tartaric acid.

In an embodiment, the organic acid comprises polylactic acid and/or polylactic-co-glycolic acid.

In an embodiment, the method may further comprise reverting the non-aqueous gravel pack carrier fluid to a water-wet state prior to the at least one portion of the filter cake being degraded.

In an embodiment, the method may further comprise decreasing the pH of the gravel pack to a lower pH value to revert the non-aqueous gravel pack carrier fluid to the water-wet state, wherein the lower pH value is less than about 5, less than about 4, less than about 3, or between about 2 and about 3.

In one or more embodiments, a method for gravel packing a wellbore is provided. The method may comprise running a sand control screen assembly to a selected depth within the uncased section of the wellbore to facilitate a gravel packing operation and introducing a gravel pack slurry comprising non-aqueous gravel pack carrier fluid and degradable polyester into the wellbore to facilitate gravel packing operations.

In an embodiment, the degradable polyester is in the form of sized degradable polyester particles.

In an embodiment, the gravel pack slurry further comprises proppants and the degradable polyester is infused into or coated onto at least a portion of the proppants.

In an embodiment, the non-aqueous gravel pack carrier fluid is a reversible invert emulsion carrier fluid.

In an embodiment, the method may further comprise decreasing the pH of the gravel pack slurry to a lower pH value to revert the non-aqueous gravel pack carrier fluid to a water-wet state, wherein the lower pH value is less than about 5, less than about 4, less than about 3, or between about 2 and about 3.

In an embodiment, an organic acid releasable from the degradable polyester comprises at least one acid selected from polylactic acid, polyglycolic acid, polylactic-co-glycolic acid, polymalic acid, polygluconic acid, poly citric acid, poly mandelic acid, polysaccharide acid, poly mucic acid, and poly tartaric acid.

In an embodiment, the organic acid of the degradable polyester hydrolyzes and decreases the pH of the gravel pack to a pH value that is less than about 5 or that ranges from about 1 to about 5, from about 1.5 to about 4, or from about 2 to about 3.

In an embodiment, the method may further comprise introducing a filter cake breaker fluid system into the wellbore and degrading at least one portion of a filter cake disposed within the wellbore.

In one or more embodiments, a gravel pack system configured for gravel packing an interval of a wellbore traversing a subterranean formation is provided. The gravel pack system may comprise a reversible invert emulsion gravel pack carrier fluid comprising an alkaline agent, an amine as a primary emulsifier, and a tall-oil fatty acid as a secondary emulsifier, a plurality of proppants, and degradable polyester.

In an embodiment, the degradable polyester is in the form of sized degradable polyester particles or are infused within or coated onto at least one proppant of the plurality of proppants.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
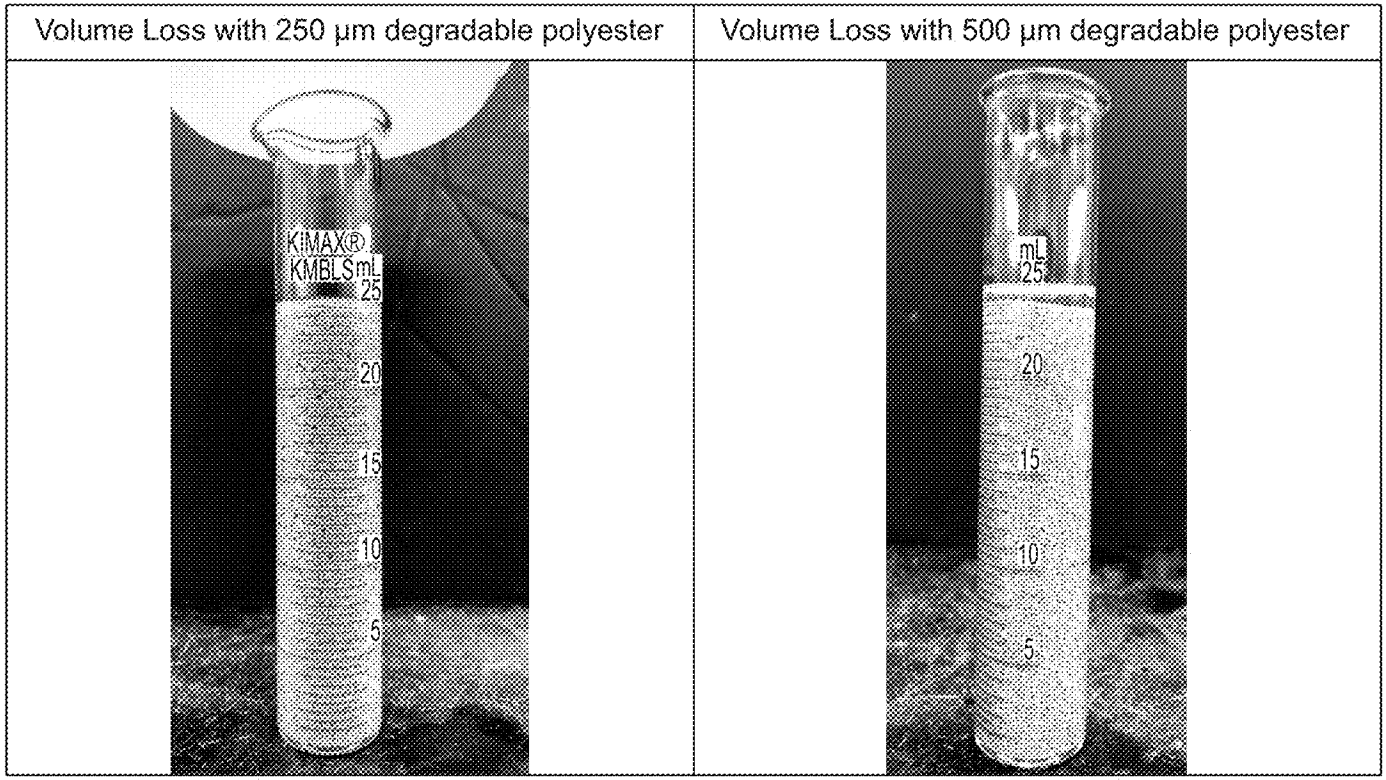
FIG. 1 illustrates gravel pack shrinkage evaluations of 250 and 500 μm degradable polyester particles, according to one or more examples of the disclosure.

Illustrative examples of the subject matter claimed below will now be disclosed. In the interest of clarity, not all features of an actual implementation are described in this specification. It will be appreciated that in the development of any such actual implementation, numerous implementation-specific decisions may be made to achieve the developers' specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

Further, as used herein, the article "a" is intended to have its ordinary meaning in the patent arts, namely "one or more." Herein, the term "about" when applied to a value generally means within the tolerance range of the equipment used to produce the value, or in some examples, means plus or minus 10%, or plus or minus 5%, or plus or minus 1%, unless otherwise expressly specified. Further, herein the term "substantially" as used herein means a majority, or almost all, or all, or an amount with a range of about 51% to about 100%, for example. Moreover, examples herein are intended to be illustrative only and are presented for discussion purposes and not by way of limitation.

The present disclosure is generally directed to systems and methods that deliver degradable polyester during gravel packing and enhance the performances of one or more downhole operations and/or applications (collectively referred to hereinafter as "the present systems and methods"). The present systems and methods may comprise at least one filter cake breaker composition or fluid system (hereinafter "the filter cake breaker system"), at least one gravel pack slurry, composition, or system (hereinafter "the gravel pack slurry"), at least one sized degradable polyester particle comprising one or more degradable polyesters (hereinafter "the degradable polyester particle"), and/or at least one or more proppants infused with and/or coated by degradable polyester (hereinafter "the infused/coated proppant"). The one or more degradable polyesters (hereinafter "the degradable polyester") may be included or incorporated into at least one of the filter cake breaker system, the gravel pack slurry, the degradable polyester particle, and/or the infused/coated proppant. Filter cakes disposed upon walls of the wellbores may be degraded and/or removed from the walls by one or more interactions and/or reactions between the filter cake breaker system, the gravel pack slurry, the degradable polyester particle, the degradable polyester, and/or the infused/coated proppant.

The filter cake breaker system, the gravel pack slurry, the degradable polyester particle, the degradable polyester, and/or the infused/coated proppant (collectively referred to hereinafter as "the present compounds") of the present systems and methods may produce acid overtime and, in effect, may be less hazardous to personnel. Moreover, because of this time-dependent release of acid, the present compounds may be able to flow further into the wellbore before reacting to reduce pH, allowing specific placement of the present compounds into a given interval of interest. Thus, where targeting of a particular interval of the wellbore is desired, the present compounds may allow for more complete removal of filter cakes and reduce formation damage that may result in the creation of fluid loss zones.

The proppants and/or the infused/coated proppants are sized particles that are mixed with gravel-pack carrier fluid (hereinafter "GPCF"). In embodiments, the proppants and/or the infused/coated proppant may be naturally occurring sand grains, man-made or specially engineered proppants, such as, for example, resin-coated sand or porous ceramic materials like sintered bauxite. The proppants and/or the infused/coated proppant may be sorted for size and sphericity to provide an efficient conduit for gravel packing operations. In some embodiments, the proppants and/or the infused/coated proppant may have sieved standard sizes, such as, for example, 12/18, 16/20, 20/40, 30/50, or 40/70.

In one or more embodiments, the proppants and/or the infused/coated proppant may be or may comprise intermediate-density ceramic proppants, low-density ceramic proppants, and/or ultra-low-density ceramic proppants. The proppants and/or the infused/coated proppant may have a bulk density and/or specific gravity that may be the same as or substantially similar to the bulk density and/or specific gravity of sand. As a result, the gravel packing operations utilizing the proppants and/or the infused/coated proppant disclosed herein may achieve and provide high-quality gravel packs at low fluid viscosities and/or pump rates.

In some embodiments, the proppants and/or the infused/coated proppant may be ultra-low-density ceramic proppants with one or more engineered internal porosities. For example, the proppants and/or the infused/coated proppant may have a specific gravity of about 1.8, about 2.0, or about 2.2. As a result, the specific gravity of the proppants and/or the infused/coated proppant may be about 20%, about 25%, or about 30% lower than sand, resin-coated sand, or low-density ceramics. Additionally, the proppants and/or the infused/coated proppant may have slower settling rates than sand, resin-coated sand, or low density ceramics. For example, the settling rates of the proppants and/or the infused/coated proppant may be from about 20 to about 50%, from about 25 to 45%, or from about 30 to about 40% slower than settling rates of sand, resin-coated sand, or low-density ceramics. In an embodiment the conductivity, strength, and/or durability of the proppants and/or the infused/coated proppant may exceed the conductivity, strength, and/or durability of sand, resin-coated sand, or low density ceramics.

In one or more embodiments, the infused/coated proppant may be one or more porous ceramic proppants infused with and/or coated by the degradable polyester having engineered or preformed porosities that allow the infused/coated proppant to function as both a gravel pack proppant and a chemical delivery system for the infused and/or coated degradable polyester. The porosities of the one or more porous ceramic proppants may allow slow and/or predetermined release of infused and/or coated degradable polyester into the wellbore along with maximum pore-space to infuse and/or coat the degradable polyester.

In some embodiments, the one or more porous ceramic proppants may be fully or partially encapsulated and/or coated with a resin or encapsulation material. The proppant coated with the degradable polyester may be fully or partially encapsulated and/or coated with a coating or covering of the degradable polyester (hereinafter "the degradable polyester covering"). In one or more embodiments, the degradable polyester covering may extend over a portion of the exterior surface of the proppant to encapsulate and/or coat the coated proppants. The portion of the exterior surface of the proppant having the degradable polyester covering disposed thereon may be at least about 10%, at least about 25%, at least about 50%, at least about 75%, at least about 90%, at least about 95%, or at least about 99%. Further, the portion of the exterior surface of the proppant having the degradable polyester covering disposed thereon may be less than about 99%, less than about 95%, less than about 90%, less than about 75%, or less than about 50%. In an embodiment, the entire exterior surface of the proppant is covered or encapsulated by the degradable polyester covering.

The filter cake breaker system, the gravel pack slurry, the degradable polyester, the degradable polyester particle, and/or the infused/coated proppant according to the present disclosure may be utilized in both cased hole gravel packing and open hole gravel packing in one or more vertical wells, deviated wells, and/or horizontal wells. Additionally, the filter cake breaker system, the gravel pack slurry, the degradable polyester, the degradable polyester particle, and/or the infused/coated proppant may be utilized for gravel packing operations in low frac gradient pressure window environments and/or narrow frac formation pressure window environments. Further, the filter cake breaker system, the gravel pack slurry, the degradable polyester, the degradable polyester particle, and/or the infused/coated proppant may be utilized for gravel packing operations comprising one or more multi-path screen horizontal open hole gravel packs and/or erosion-sensitive downhole tools and/or equipment.

In one or more embodiments, the filter cake breaker system of the present systems and methods may include wellbore fluids containing a degradable polymeric breaker, the degradable polyester, and/or the degradable polyester particle that releases acid upon exposure to a number of stimuli that may include changes in temperature and pH or exposure to various solvents. In some embodiments, the degradable polyester may comprise or may be one or more organic acid precursors. For example, in some embodiments, the filter cake breaker system, the degradable polyester, the degradable polyester particle, and/or the infused/coated proppant may be used as a delayed filter cake breaker that slowly hydrolyzes and releases acidic byproducts that dissolve or degrade acid-soluble components in the filter cake. After a sufficient amount of time, the released acids may degrade filter cake to such an extent that the filter cake may be removed by pumping or washing the degraded filter cake residue from the wall of the wellbore.

In embodiments, the filter cake breaker system, the gravel pack slurry, the degradable polyester, the degradable polyester particle, and/or the infused/coated proppant of the present systems and methods may also be used in conjunction with sand control methods such as gravel packing that involve the use of sand screens and other hardware. For example, a sand control screen assembly may be emplaced within a selected depth within an uncased section of the wellbore to facilitate a gravel packing operation. The gravel packing operation may involve mixing gravel or proppants, the degradable polyester, the degradable polyester particle, and/or the infused/coated proppant with a gravel packing carrier fluid to produce the gravel pack slurry, and then pumping the gravel pack slurry down the tubing and through a cross-over and into an annulus created between an emplaced screen and an uncased interval of the wellbore. The gravel pack carrier fluid in the gravel pack slurry may then leak off into the subterranean formation and/or through the screen. The screen may prevent the gravel or proppants, the degradable polyester, the degradable polyester particle, the infused/coated proppant, and/or other materials in the gravel pack slurry from entering the production tubing, causing gravel and other additives to deposit in the annulus around the screen and forming the gravel pack. The gravel pack then serves to prevent sand and other formation fines from flowing into the wellbore.

The gravel packing operation is sand-control method used to prevent production of formation sand. In gravel pack operations, a steel gravel-pack screen is placed in the wellbore and the surrounding annulus packed with the gravel or proppant, the degradable polyester particle, and/or the infused/coated proppant of a specific size designed to prevent the passage of formation sand. The gravel pack slurry disclosed herein is usable for gravel packing operations to stabilize the formation while causing minimal impairment to well productivity. The gravel-pack screen is a metal filter assembly used to support and retain the sand placed during gravel pack operations utilizing the gravel pack slurry disclosed herein. An open hole gravel pack is a type of sand-control completion in which the gravel pack screen is packed off in an open hole section with no casing or liner to support the producing formation. The open hole interval is often prepared by underreaming a section of reservoir below the last casing shoe. When the treatment is to be applied on an existing well, a section of casing may be milled out. One or more of the filter cake breaker system, the gravel pack slurry, the degradable polyester, the degradable polyester particle, and/or the infused/coated proppant disclosed herein may be utilized in an open hole gravel pack.

In some embodiments, the degradable polyester, the degradable polyester particle, and/or the infused/coated proppant may be added to a gravel pack carrier fluid in place of or in addition to the gravel or proppant and pumped downhole to fill the annular space between the production screen and formation. In yet other embodiments, the degradable polyester, the degradable polyester particle, and/or the infused/coated proppant may be combined with at least one gravel packing material, such as, for example, bauxite, ceramic materials, glass materials, sand, polytetrafluoroethylene materials, nutshell pieces, cured resinous particulates, nutshell pieces, seed shell pieces, fruit pit pieces, cured resinous particulates comprising fruit pit pieces, wood, composite particulates, carbons, metal oxides, and the like.

Embodiments directed to the present methods disclosed herein may encompass both open-hole and cased-hole operations. For instance, in an open-hole completion, the gravel pack slurry in accordance with the present disclosure may be positioned between the wall of the wellbore and a sand screen that surrounds a perforated base pipe. In a cased-hole completion, the gravel pack slurry in accordance with the present disclosure may be positioned between a perforated casing string and a sand screen that surrounds a perforated base pipe.

The degradable polyester and/or the degradable polyester particle in accordance with the present disclosure may be or based upon polyacids produced from the polymerization of one or more organic acids. The one or more organic acids are unique in that, upon exposure to an appropriate stimulus, the polyacids hydrolyze and release acidic monomers or organic acids that decrease the pH of the surrounding medium, which may find particular use in the removal of filter cakes prior to the initiation of production. The degradable polyesters and/or the degradable polyester particles may be added to the gravel pack slurry during or prior to the process of gravel packing. Thus, the degradable polyester and/or the degradable polyester particle may be emplaced or introduced into the wellbore in combination with the gravel pack slurry.

During use, the degradable polyester and/or the degradable polyester particle may then slowly hydrolyze and release an acidic byproduct once dispersed in a wellbore fluid or solvent containing water and/or once in contact with the filter cake breaker system. Polymer hydrolysis may depend on a number of factors that include temperature, solubility of the polyacid and released organic acid, molecular weight of the polyacid, the presence of water, and the ionic strength of the wellbore fluid or brine and/or the filter cake breaker system. In particular embodiments, the rate of hydrolysis of the polyacid and the corresponding conversion to free acid may be delayed sufficiently to enable targeted emplacement of the degradable polyester and/or the degradable polyester particle in selected intervals without premature and undesirable filter cake removal.

In one or more embodiments, wellbore fluids compositions may contain at least one of the degradable polyester and/or the degradable polyester particle may hydrolyze at temperature of 120° F. (49° C.) or greater. In other embodiments, the degradable polyester and/or the degradable polyester particle may hydrolyze at temperatures of 150° F. (66° C.) or greater. In a non-limiting example, the polyacid may be polylactic acid converted to the free acid at temperatures within the range of about 150° F. (66° C.) to about 170° F. (77° C.) to provide acid precursor to the present systems and methods and presently disclosed gravel packing operations.

In embodiments, the degradable polyester and/or the degradable polyester particle may comprise an organic degradable polyester or self-destructive bridging agent that is a versatile additive usable in self-degradable fluid loss pills and/or filter cake breakers. With sufficient temperature, organic degradable polyester reacts with an aqueous phase and dissolves itself, thereby releasing acid that will destroy nearby filter cake components and eliminate the need for postplacement cleanup. As a filter cake breaker, the organic degradable polyester may be present at concentrations from about 15 to about 100 lbm/bbl (i.e., from about 42.8 to about 285 kg/m$^3$), which may depend upon a breakthrough time required and a composition of reservoir drill-in fluid. The organic degradable polyester may degrade rapidly at temperature above about 220° F. (i.e., above about 104° C.) and/or may not activate below about 170° F. (i.e., below about 77° C.). The organic degradable polyester may have a specific gravity ranging from about 1.1 to about 1.40, from about 1.5 to about 1.3, from about 1.20 to about 1.25. The organic degradable polyester may have particle sizes ranging from about 2 to about 500 μm, from about 100 to about 400 μm, from about 200 to about 300 μm, or from about 225 to about 275 μm. In an embodiment, the organic degradable polyester may have a median particle size (D50) from about 225 to about 275 μm or from about 475 to about 525 μm.

Polyacids in accordance with the present disclosure may be formed from a number of possible monomers including, but not limited to lactic acid, malic acid, gluconic acid, glycolic acid, citric acid, mandelic acid, saccharic acid, mucic acid, tartaric acid, 3-hydroxybutyric acid, 4-hydroxybutyric acid, 4-hydroxyvaleric acid, 5-hydroxyvaleric acid and 6-hydroxycaproic acid. In an embodiment, the degradable polyester and/or the degradable polyester particle may comprise at least one polyhydroxycarboxylic acid. It is also within the scope of the present disclosure that any of the above monomers may be co-polymerized to produce copolymers, block copolymers, or higher order polymers such as terpolymers or quaternary polymers.

In one or more embodiments, a wellbore fluid, the filter cake breaker system, and/or the gavel pack slurry containing the degradable polyester and/or the degradable polyester particle may be emplaced within an interval of a wellbore containing a degradable filter cake to aid in the removal of the filter cake. The degradable polyester and/or the degradable polyester particle disclosed herein may be D-GRADE™, which is commercially available from M-I, L.L.C. (Houston, Texas). The wellbore fluid and/or the filter cake breaker system may also include water and brines containing various electrolytes and their blends, such as, for example, but not limited to, NaCl, KCl, CaCb, $CaBr_2$, $ZnBr_2$, or a combination thereof.

In one or more embodiments, the wellbore fluids, the filter cake breaker system, and/or the gravel pack slurry in accordance with this disclosure may contain the degradable polyester and/or the degradable polyester particles at a percent by weight (wt. %) concentration having a lower limit equal or greater than 0.05 wt. %, 0.1 wt. %, 0.5 wt. %, 1 wt. %, and 5 wt. %, to an upper limit of 0.5 wt. %, 1 wt. %, 5 wt. %, 7 wt. %, and 10 wt. %, wherein the wt. % concentration of the degradable polyester and/or the degradable polyester particle may range from any lower limit to any upper limit.

In one or more embodiment, the hydrolyzes of the degradable polyester and/or the degradable polyester particle may decrease the pH of the gravel pack slurry to a pH value ranging from about 1 to about 5, from about 1.5 to about 4, or from about 2 to about 3.

In some embodiments, the degradable polyester particle may be added in granular form and/or in the form of a polymeric fiber, a flake material, and/or the like.

In one or more embodiments, the degradable polyester particle may be mixed with the gravel or proppant of the gravel pack slurry at a ratio of percent by weight of degradable polyester particle to the gravel or proppant that may range from about 5:1 to about 1:5, from about 3:1 to about 1:3, or from about 3:1 to about 1:1. In some embodiments, the ratio of percent by weight of degradable polyester particle to the gravel or proppant that may up to or greater than about 1:10, may be up to about 1:20, may be less than or equal to about 1:20, or may range from about 1:10 to about 1:20. It is also envisioned that, in some embodiments, that gravel packing operations may be performed using the precursor particle and the infused/coated proppant while excluding additional gravel additives. In other embodiments, the degradable polyester particle may hydrolyze at a temperature of 120° F. (49° C.) or greater.

It is further contemplated that gravel packing operations disclosed herein may include an initial gravel pack emplaced for the purposes of sand control with a possible secondary gravel pack emplaced for remedial purposes. Additionally, one or more of the initial gravel pack and the secondary gravel pack may comprise at least one of the degradable polyester, the degradable polyester particle, and/or the infused/coated proppant.

The infused degradable polyester of the infused/coated proppant may dissolve in the wellbore, when emplaced with the gravel pack. However, a consolidated gravel pack may be maintained since the dissolved degradable polyester of the infused/coated proppant does not create any voids and/or empty spaces. Rather, the infused/coated proppant maintains the consolidated gravel pack after the degradable polyester dissolves into the wellbore.

In embodiments, the filter cake breaker system may comprise one or more of the following components: wellbore fluid; water; at least one delaying viscosifier or at least one polymer fluid loss control additive; the degradable polyester; the degradable polyester particle; at least one additional acid precursor; at least one chelating agent; at least one surfactant; at least one surface tension reducer; at least one corrosion inhibitor; and/or one or more combinations thereof.

The wellbore fluid may comprise water and/or brines containing various electrolytes and their blends. In some embodiments, the wellbore fluid may further comprise at least one selected from NaCl, KCl, CaCb, $CaBr_2$, $ZnBr_2$, and at least one combination thereof.

In one or more embodiments, the at least one delaying viscosifier or the at least one polymer fluid loss control additive may comprise, for example, hydroxy ethyl cellulose. The liquid polymer fluid loss control additive may be present at a concentration ranging from about 0.5 to about 2.0 lbm/bbl (i.e., from about 1.4 to about 5.7 $kg/m^3$). As a result, the liquid polymer fluid loss control additive may suspend one or more solids for filter cake breaker applications. The at least one delaying viscosifier or the at least one polymer fluid loss control additive disclosed herein may be SAFE-VIS E™, which is commercially available from M-I, L.L.C. (Houston, Texas).

In some embodiments, the at least one additional acid precursor may be an organic acid precursor designed for high-density breaker applications that require zinc bromide as base brine. The at least one additional acid precursor may convert to organic acid, without water, at a given temperature and/or time and may slowly release organic acid through hydrolysis, which may help to minimize losses during breaker placement and to achieve uniform filter cake removal across the open hole. Due to its slow-acting nature, the filter cake breaker system may be spotted and the work string may be extracted from the open hole section without losing fluid into the formation. Additionally, the filter cake breaker system may soak for an extended period, enabling a thorough and uniform filter cake removal while maintaining completion hardware integrity. In embodiments, the at least one additional acid precursor may be present at concentrations of less than about 25% by volume, less than about 20% by volume, or less than about 15% by volume. The at least one additional acid precursor disclosed herein may be D-STRUCTOR™, which is commercially available from M-I, L.L.C. (Houston, Texas).

In embodiments, the at least one chelating agent may be at least one brine-soluble chelating agent having low pH value from about 4.0 to about 5.5 or from about 4.4 to about 5.0. The at least one chelating agent may have complex metal ions present in filter cakes and completion fluids, such as, for example, calcium, magnesium, and a combination thereof. The at least one chelating agent may have a relative density from about 1.05 to about 1.35 or from about 1.15 to about 1.25. The at least one chelating agent may be a calcium carbonate dissolver that may enhance the filter cake breaker system and may act on both divalent and trivalent metal ions. The at least one chelating agent may perform over temperature ranges from about 75° F. (i.e., 24° C.) to about 350° F. (i.e., 177° C.). In embodiments, the at least one chelating agent may be at least one selected from EDTA (ethylenediamine tetraacetic acid), HEDTA (hydroxyethylenediamine triacetic acid), NTA (nitriolotriacetic acid), citric acid, and at least one combination thereof. The at least one chelating agent disclosed herein may be D-SOLVER EXTRA™, which is commercially available from M-I, L.L.C. (Houston, Texas).

In some embodiments, the at least one surfactant may be incorporated into at least one solvent and/or at least one base oil. The at least one surfactant may be a blend of mutual solvents and nonionic surfactants configured or adapted to penetrate and water-wet invert emulsion filter cakes. This process readies the filter cake for destruction by other components of the filter cake breaker system. The at least one surfactant may be used by itself in a brine to help disperse an invert emulsion, barite-laden filter cake, or the at least one surfactant may be used along with a breaker to assist in dissolving the soluble components in the filter cake. When included in the filter cake breaker system, the at least one surfactant penetrates and water-wets the filter cake to enable the active component of the breaker, such as a degradable polyester breaker and/or the at least one additional acid precursor, to dissolve filter cake components. The at least one surfactant may be present at a concentration ranging from about 1 to about 12% by volume, from about 2 to about 10% by volume, or from about 3 to about 8% by volume. The at least one surfactant performs at temperatures ranging up to about 300° F. (i.e., up to about 149° C.). The one or more surfactants may have a specific gravity ranging from about 0.96 to about 1.10, a pH ranging from about 7.5 to about 9, and a flash point of greater than about 212° F. (i.e., greater than about 100° C.). The at least one surface tension reducer disclosed herein may be DEEPCLEAN™ or PEN-8™, which are both commercially available from M-I, L.L.C. (Houston, Texas).

In one or more embodiments, the at least one surface tension reducer may be, for example, an ethoxylate alcohol-based surfactant. The at least one surface tension reducer disclosed herein may be FLOW-BAK™, which is commercially available from M-I, L.L.C. (Houston, Texas).

In one or more embodiments, the gravel pack slurry comprises at least one reversible non-aqueous gravel-pack carrier fluid and a plurality of gravel particles and/or proppants along with at least one selected from the degradable polyester, the degradable polyester particles, and/or the infused/coated proppants. In some embodiments, the at least one reversible non-aqueous gravel-pack carrier fluid is an invert-emulsion gravel-pack carrier fluid (hereinafter "IEGPCF") that has been formulated to be reversible such that the IEGPCF reverts to a water-wet state (i.e., reversed state) when low pH fluids, such as, the filter cake breaker system are in the wellbore. The reversible IEGPCF according to the present disclosure comprises at least an alkaline agent, an amine as a primary emulsifier, and an emulsion stabilizer as a secondary emulsifier. In some embodiments, the alkaline agent may be lime, the primary emulsifier may be bis (2-hydroxyethyl) oleyl amine, and/or the secondary emulsifier may be an invert-emulsion fluid stabilizer that is usable at oil/water ratios ranging from about 60:40 to about 45:55. In some embodiments, the oil/water ratio may be less than about 45:55, may be at least 30:70, or may range from about 45:55 to about 30:70. In one embodiment, the primary and secondary emulsifiers disclosed herein may be FAZE-MUL™ and PRIMO-SURF™ respectively, which are both commercially available from M-I, L.L.C. (Houston, Texas). Moreover, the gravel pack slurry comprising the reversible IEGPCF according to the present disclosure may also be referred to hereinafter as "the fluid/gravel/acid precursor mixtures".

In some embodiments, the reversible IEGPCF may mitigate the risks associated with transitioning from a synthetic- or oil-base drill-in fluid to a brine-based carrier fluid and spacer for open hole gravel-pack completions in reactive shales. When applied as a high-rate gravel pack, the reversible IEGPCF may be utilized in horizontal wells, deviated wells, and/or vertical wells drilled with synthetic- or oil-based mud and completed with an open hole gravel pack. The reversible IEGPCF may maintain low viscosity at up to about 300° F. (i.e., about 149° C.) bottomhole static temperature and/or about 13.3 ppg (i.e., about 1.6 sg). The reversible IEGPCF may have a fluid viscosity that ranges: from about 30 to about 40 cP at a shear rate ranging from about 10 to about 100 1/s at a temperature about 100° F.; from about 20 to about 30 cP at a shear rate ranging from about 10 to about 100 1/s at a temperature about 120° F.; and/or from about 15 to about 22 cP at a shear rate ranging from about 10 to about 100 1/s at a temperature about 150° F. Further, the reversible IEGPCF may be emulsified with any type of brine (water; KCl; $CaCl_2$); NaBr; KCOOH; $CaBr_2$; CACOOH; and $ZnBr_2$) to provide a gravel-pack fluid density from about 5 to about 18 lbm/galUS, from about 10 to about 15 lbm/galUS, or from 7.6 to about 13.6 lbm/galUS.

For known non-aqueous gravel-pack carrier fluids, it was determined that the non-aqueous phases trapped in the pore spaces of gravel pack was inhibiting the diffusion of aqueous phase filter cake breaker system through the gravel. To avoid this inhibition of the filter cake breaker system diffusion, the novel and inventive reversible IEGPCF was formulated to provide a viable filter cake breaker for gravel packing operations. The reversible IEGPCF reverts to a water-wet state when the low pH breaker solution or the filter cake breaker system may be disposed within the wellbore. In the water-wet state, the reversible IEGPCF promotes the migration of breaker through the gravel pack. Additionally, pumping sized acid-generating particles (i.e., the degradable polyester particle) with the proppant during gravel-pack pumping attacks the reversible IEGPCF from inside via the acid-generating degradable particles (i.e. the degradable polyester particle). As a result, the filter cake breaker system may pass through the gravel and attack the filter cake disposed on walls of the wellbore. The known non-aqueous gravel-pack carrier fluids may be PrimoPAC™ (hereinafter "PrimoPAC"), which is commercially available from M-I, L.L.C. (Houston, Texas).

During field study, the reversible IEGPCF was introduced or pumped into wellbores having reactive shale interbeds within the reservoir sections of the wellbores. In one or more wellbores, the degradable polyester particles along with the proppant were pumped downhole during gravel-pack pumping operations. The degradable polyester particles were present at about 5% by weight of the pumped proppant to attack the reversible IEGPCF from inside gravel pack slurry. As a result, the filter cake breaker system diffused through the gravel much easier and successfully attacked and/or removed the filter cake. The reversible IEGPCF was designed with a specific gravity of about 1.31.

In Table 2, Formulation #1 represents the original recipe of PrimoPAC and Formulation #2 is the novel and inventive reversible IEGPCF. PrimoPAC only uses PRIMO-SURF as the primary emulsifier. In the reversible IEGPCF, FAZEMUL acts as the primary emulsifier and PRIMO-SURF contributes to the better emulsion stability of the fluid.

Figure 16:
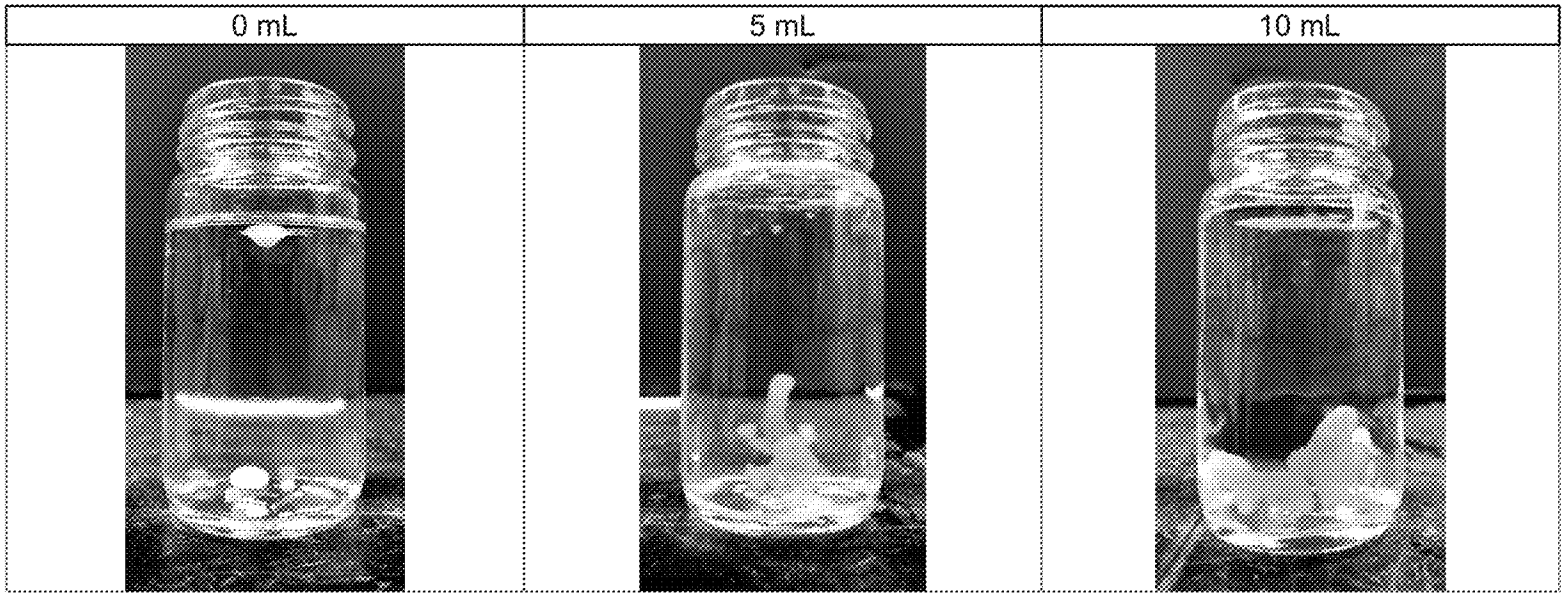
FIG. 16 illustrates reversibility properties of 1.31 specific gravity reversible IEGPCF, according to one or more examples of the disclosure.

Environmental Drilling Compound (hereinafter "EDC") comprise one or more synthetic base fluids or oils. EDC drilling fluids may have ultra-low aromatic contents that are significantly less than that of other available drilling fluid products. In some embodiments, the EDC drilling fluids may have a complex and variable combination of paraffinic and cyclic hydrocarbons having a carbon number range predominantly of about C11 to about C14, may boil in the range of approximately about 180° C. to about 270° C., and/or may have a total aromatic content between about 2% and about 0.03%. A few examples of commercially available EDC drilling fluids are: EDC 170 SE; EDC 95-11; EDC 99-DW; EDC Diamond; EDC 170 SE; and EDC 200 SE The GPCF products and their function are listed in Tables 1-3 show rheology properties and reversibility properties, respectively, of 1.31 for the reversible IEGPCF and/or reversibility properties of 1.31 SG reversible IEGPCF may be shown in FIG. 16.

TABLE 1

List of GPCF Products and Their Functions

| GPCF Products | SG | Function |
|---|---|---|
| Lime | 0.818 | Alkalinity |
| FAZEMUL | 2.200 | Primary Emulsifier |
| PRIMOSURF | 0.910 | Secondary Emulsifier |

TABLE 2

Formulations of 1.31 Reversible IEGPCF

| Formulation No | | #1 | | | #2 | | |
|---|---|---|---|---|---|---|---|
| Reversibility | Y/N | No | | | Yes | | |
| Oil-Water Ratio | OWR | 45/55 | | | 45/55 | | |
| Final System Density | SG | 1.31 | | | 1.31 | | |
| Final Brine Density | SG | 1.64 | | | 1.64 | | |
| Products | SG | Concentration | | | Concentration | | |
| | | lb/bbl | kg/m³ | vol/vol | lb/bbl | kg/m³ | vol/vol |
| EDC 170 SE | 0.818 | 110.07 | 316.45 | 0.384 | 110.07 | 316.45 | 0.384 |
| Lime | 2.200 | 0.50 | 1.44 | 0.001 | 0.50 | 1.44 | 0.001 |
| FAZEMUL | 0.910 | — | — | — | 7.00 | 20.13 | 0.022 |
| PRIMOSURF | 0.950 | 7.00 | 20.13 | 0.021 | 1.00 | 2.88 | 0.003 |
| 14.2 lb/gal $CaBr_2$ | 1.704 | 320.70 | 922.01 | 0.538 | 320.70 | 922.01 | 0.538 |
| Water | 1.000 | 19.71 | 56.67 | 0.056 | 19.71 | 56.67 | 0.056 |

TABLE 3

Rheology Properties of 1.31 SG Reversible IEGPCF

| Aging Status | | Initial | | ASA | |
|---|---|---|---|---|---|
| Aging Temperature | ° C. | | | 138 | |
| Aging Hours | hrs | | | 16 | |
| Aging Mode | D/S | | | S | |
| Rheology Temperature | ° C. | 49 | 4 | 27 | 49 |
| 600 RPM | (lb/100 ft²) | 38 | 118 | 47 | 35 |
| 300 RPM | (lb/100 ft²) | 21 | 68 | 28 | 19 |
| 200 RPM | (lb/100 ft²) | 15 | 47 | 20 | 14 |
| 100 RPM | (lb/100 ft²) | 8 | 28 | 11 | 8 |
| 6 RPM | (lb/100 ft²) | 1 | 3 | 1 | 1 |
| 3 RPM | (lb/100 ft²) | 1 | 2 | 1 | 1 |
| PV | cP | 17 | 50 | 19 | 16 |
| YP | (lb/100 ft²) | 4 | 18 | 9 | 3 |
| LSYP | (lb/100 ft²) | 1 | 1 | 1 | 1 |
| ES | V | 277 | — | — | 180 |

Reversible IEGPCF Stability Stress Test

While the reversible IEGPCF and degradable polyester particles did promote easier passage for the breaker, the strategy raised concern about the emulsion stability of the reversible IEGPCF which may be crucial for shale inhibition while packing since the degradable polyester particle hydrolyses with temperature releasing organic acid.

The stress test for reversible IEGPCF was set up to ensure the stability of the fluid during pumping. The circulating temperatures during the pumping job was simulated using SandCADE™ gravel-pack design and evaluation software, which is commercially available from Schlumberger (Houston, Texas), for two scenarios as shown in Table 4. The simulation was provided by Schlumberger Completions.

TABLE 4

Summary of Gravel Packing Simulations for BHCT

| Scenario | OH Length (m) | Pump Rate (L/min) | Average BHST (° C.) | Average BHCT (° C.) |
|---|---|---|---|---|
| 1 | 200 | 954 | 140 | 110 |
| 2 | 700 | 954 | 112 | 83 |

Fluid Composition

From the proppant and degradable polyester particle concentrations (2 pounds of proppant added (hereinafter "ppa") and 5% wt), the fluid composition was calculated as below:

Volume of GPCF=300 mL (equivalent to 0.86 $m^3$);

Gravel Loading=72 g (equivalent to 2 ppa in 0.86 $m^3$); and

D-GRADE Loading=3.5 g (equivalent to 5% wt of gravel loading).

Testing Protocol

For the temperatures, the highest average BHCT (110° C.) and BHST (140° C.) were selected. The tests were set up according to the following steps:

Ovens were pre-heated to the test temperatures −110° C. and 140° C.;

The fluid/gravel/D-GRADE mixtures were loaded into the aging cells—one cell for each exposure time (30 min, 60 min and 180 min);

Exposure time started from the point the aging cell was put inside the oven until it was taken out;

Each cell was cooled down by fan for 30 mins before opening;

The fluid/gravel/D-GRADE mixtures were then remixed under slow shear for 5 mins before electrical stability (hereinafter "ES") measurements were taken; and The pictures of the bead test were taken.

Figure 6:
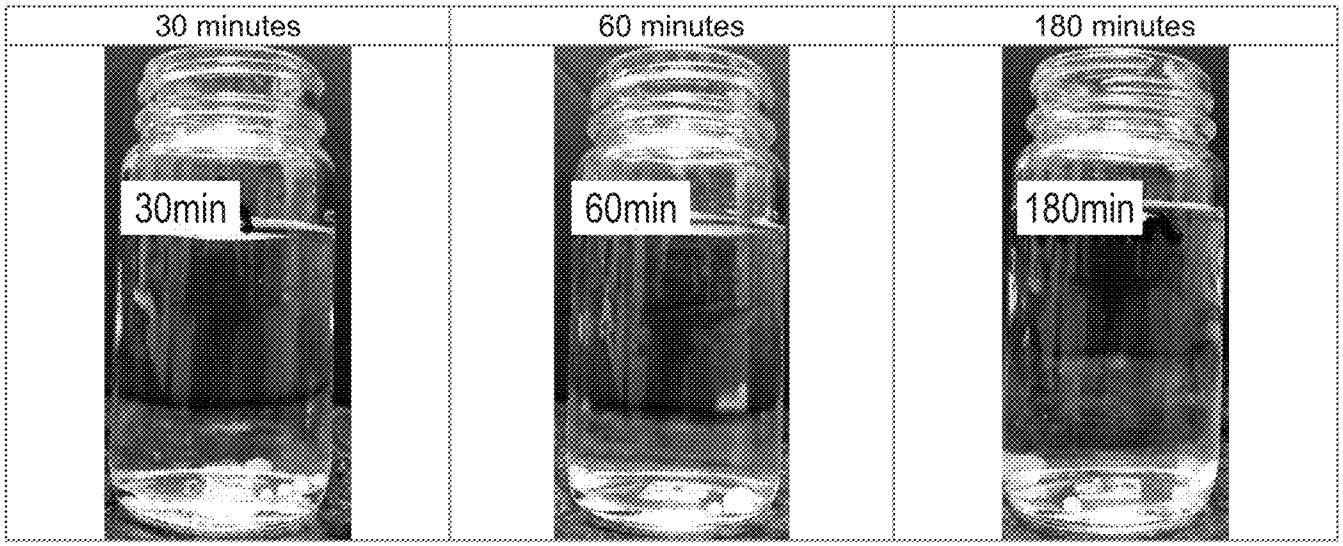
FIG. 6 illustrates bead tests results of reversible IEGPCF at 110° C., according to one or more examples of the disclosure.
Figure 7:
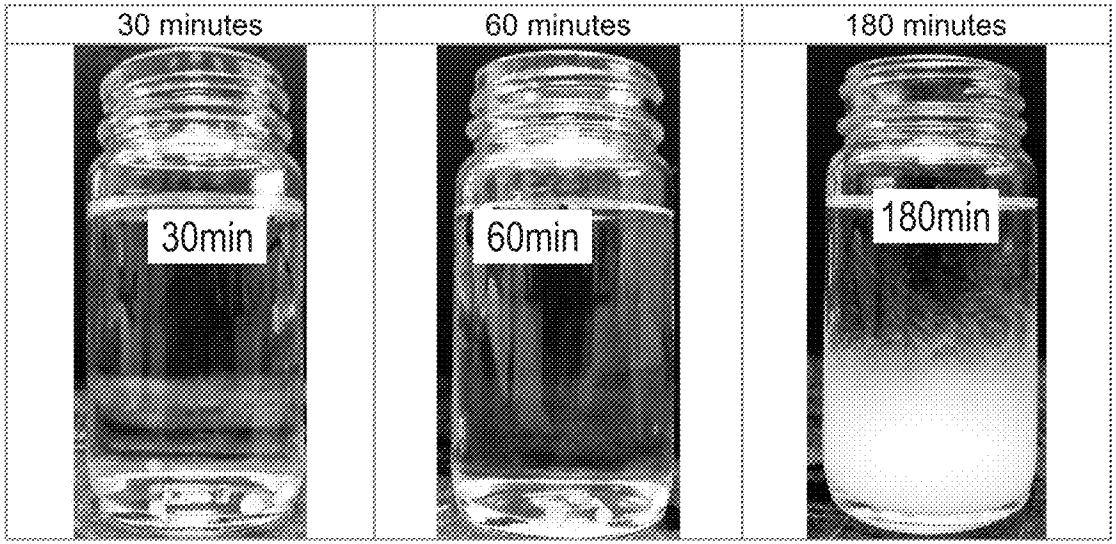
FIG. 7 illustrates bead tests results of reversible IEGPCF at 110° C., according to one or more examples of the disclosure.

The reversible IEGPCF was proven to be stable for 3 hours exposure at 110° C. and for 2 hours at 140° C. (see Table 5) and bead tests results of the reversible IEGPCF are shown in FIGS. 6 and 7.

TABLE 5

Thermal Stability of Reversible IEGPCF by Electrical Stability Measurement

| Exposure Time (mins) | 0 | 30 | 60 | 180 |
|---|---|---|---|---|
| ES @ 110° C. | 440 | 375 | 358 | 240 |
| ES @ 140° C. | 440 | 330 | 330 | 2 |

Gravel Pack Volume Shrinkage Test

Gravel pack contraction occurs when degradable polyester particles are fully hydrolyzed. Therefore, a test was conducted to determine the gravel pack shrinking due to the volume loss. Two different sizes of degradable polyester particles were evaluated—250 μm and 500 μm.

FIG. 1 shows volume losses for different sized degradable polyester particles. For 250 μm sized degradable polyester particles (see left-half of FIG. 1), 25 mL of 20/40 proppants and degradable polyester particle mixture lost about 0.5 mL which would be translated to about 2% or less of the packing length. For 500 μm sized degradable polyester particles (see right-half of FIG. 1), about 1.0 mL was lost which would be equivalent to about 4% or less of the packing length.

The Reversible IEGPCF Breakdown Test

Figure 2:
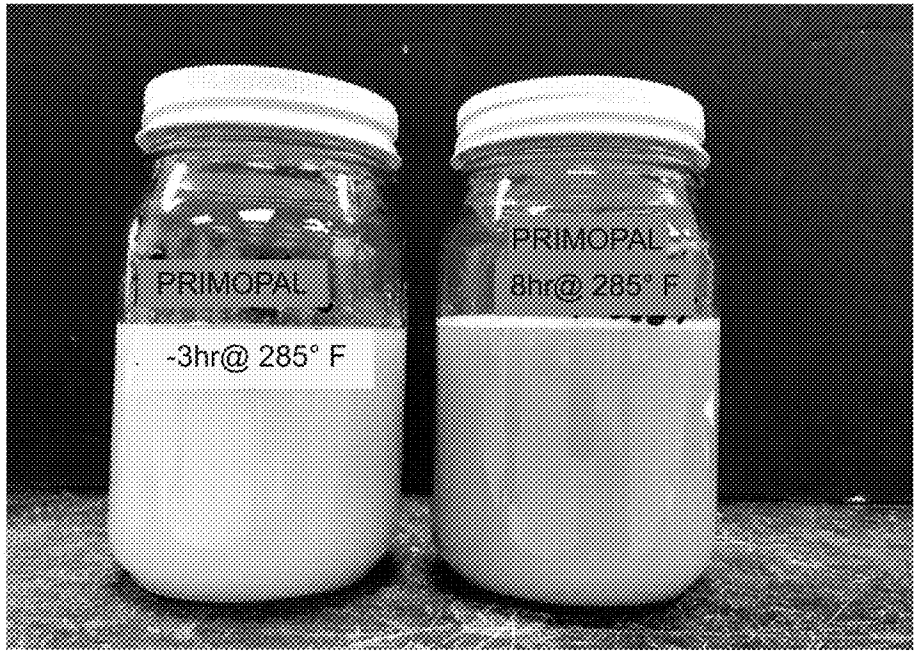
FIG. 2 illustrates broken reversible IEGPCF evaluations, according to one or more examples of the disclosure.

The rheology trend of the reversible IEGPCF was also monitored during the breakdown process. The concern was the viscosity hump which could jeopardize the gravel packing. The reversible IEGPCF was intentionally broken down by exposing it to 140° C. for 3 hours and 8 hours in the presence of the degradable polyester particle, and the rheology properties were taken (see Table 6). Images of the broken reversible IEGPCF evaluations associated with Table 6 are set forth in FIG. 2. The broken reversible IEGPCF evaluation having exposure to 285° F. (i.e., 140° C.) for 3 hours is shown on the lefthand-side of FIG. 2 and the broken reversible IEGPCF evaluation having exposure to 285° F. (i.e., 140° C.) for 8 hours is shown on the righthand-side of FIG. 2.

Little change in rheology was observed in the test which addressed the concern of potential viscosity hump. However, broken reversible IEGPCF would lose its superior shale inhibition property and could destabilize the reactive shale breaks in the reservoir.

TABLE 7

Rheology Trend of Broken Reversible IEGPCF

| Aging Status | | Initial | AHR | AHR |
|---|---|---|---|---|
| Aging Temperature | ° C. | | 285 | 285 |
| Aging Hours | hrs | | 3 | 8 |
| Rheology Temperature | ° C. | 49 | 49 | 49 |
| 600 RPM | (lb/100 $ft^2$) | 38 | 34 | 36 |
| 300 RPM | (lb/100 $ft^2$) | 21 | 18 | 20 |
| 200 RPM | (lb/100 $ft^2$) | 15 | 13 | 14 |
| 100 RPM | (lb/100 $ft^2$) | 8 | 7 | 8 |
| 6 RPM | (lb/100 $ft^2$) | 1 | 1 | 1 |
| 3 RPM | (lb/100 $ft^2$) | 1 | 1 | 1 |
| PV | cP | 17 | 16 | 16 |
| YP | (lb/100 $ft^2$) | 4 | 2 | 4 |
| ES | V | 277 | 2 | 2 |

Filter Cake Breaker Systems

For the filter cake breaker systems testing, the type of completion was taken into consideration to determine the representative volume of the filter cake breaker systems. Based on completion configuration i.e. open hole (hereinafter "OH") size, proppant porosity, completion screen's ID and OD, it was calculated that approximately 55 mL of breaker, 15 mL of IEGPCF and 100 g of proppant in the laboratory setup would represent the same ratio in the field.

The volume of the filter cake breaker systems calculated is only about 50% of typical standalone completion configuration. In addition, the dilution of the IEGPCF inside the pack must be accounted for in the filter cake breaker design or the filter cake dissolution will be compromised. Accounting the two parameters, the relevant breaker chemistries were identified and tested for the project.

TABLE 8

List of Filter cake Breaker Products and Their Functions

| Breaker Products | SG | Function |
|---|---|---|
| D-GRADE | 1.240 | Degradable Polyester/Acid Precursor |
| D-SOLVER EXTRA | 1.200 | Chelating Agent |
| D-STRUCTOR | 1.150 | Acid Precursor |
| DEEPCLEAN | 0.920 | Surfactant/Solvent |
| FLOW-BAK | 1.080 | Surface Tension Reducer |
| SAFE-VIS E | 0.960 | Delaying Viscosifier |
| A 272 | 1.000 | Corrosion Inhibitor |

Phase-1: Breaker Test

In Phase-1, breaker chemistry selection was the focus of the testing. The breakers were prepared concentrated taking the aforementioned two parameters into account. Therefore, the gravel pack was not installed for the sake of clear visual indications. Table 11 shows the formulations of the beakers tested in Phase-1. Two primary filter cake dissolving chemistries were tested—chelant and solid degradable polyester/acid precursor. D-SOLVER EXTRA is the chelating agent and D-GRADE is the degradable polyester/organic acid precursor. FAZEBREAK™ is a filter cake breaker system that is commercially available from M-I, L.L.C. (Houston, Texas).

The procedure is as follows:

1.31 SG PRIMOFAZE RDIF was used to build the 4-hour filter cake under 500 psi differential and 140° C.;

The breakers and PrimoPAC GPCF were mixed and spotted in the calculated volume ratio. It should be noted that PrimoPAC GPCF is non-reversible in Phase-1 testing;

Volume of Breaker=55 mL;

Volume of GPCF=15 mL;

The filter cakes were soaked with breakers and GPCF for 4 days; and

The HTHP cells were opened and the filter cake residues were inspected. Photos were taken.

TABLE 9

Breaker Formulations Tested in Phase-1

| Breaker System | | EMS-6460 | | | FAZEBREAK | | |
|---|---|---|---|---|---|---|---|
| Final System Density | SG | 1.33 | | | 1.31 | | |
| Final Brine Density | SG | 1.47 | | | 1.64 | | |
| Products | SG | Concentration | | | Concentration | | |
| | | lb/bbl | kg/m³ | vol/vol | lb/bbl | kg/m³ | vol/vol |
| 14.2 lb/gal CaBr2 | 1.700 | 253.70 | 729.39 | 0.426 | 166.30 | 478.11 | 0.279 |
| Water | 1.000 | 72.20 | 207.58 | 0.206 | 9.00 | 25.88 | 0.026 |
| SAFE-VIS E | 0.960 | 1.00 | 2.88 | 0.003 | — | — | — |
| D-GRADE | 1.240 | 80.00 | 230.00 | 0.184 | — | — | — |
| D-SOLVER EXTRA | 1.200 | — | — | — | 250.00 | 718.75 | 0.595 |
| DEEPCLEAN | 0.920 | 55.00 | 158.13 | 0.171 | 30.00 | 86.25 | 0.093 |
| FLOW-BAK | 1.000 | 0.40 | 1.15 | 0.001 | 0.40 | 1.15 | 0.001 |

Figure 3:
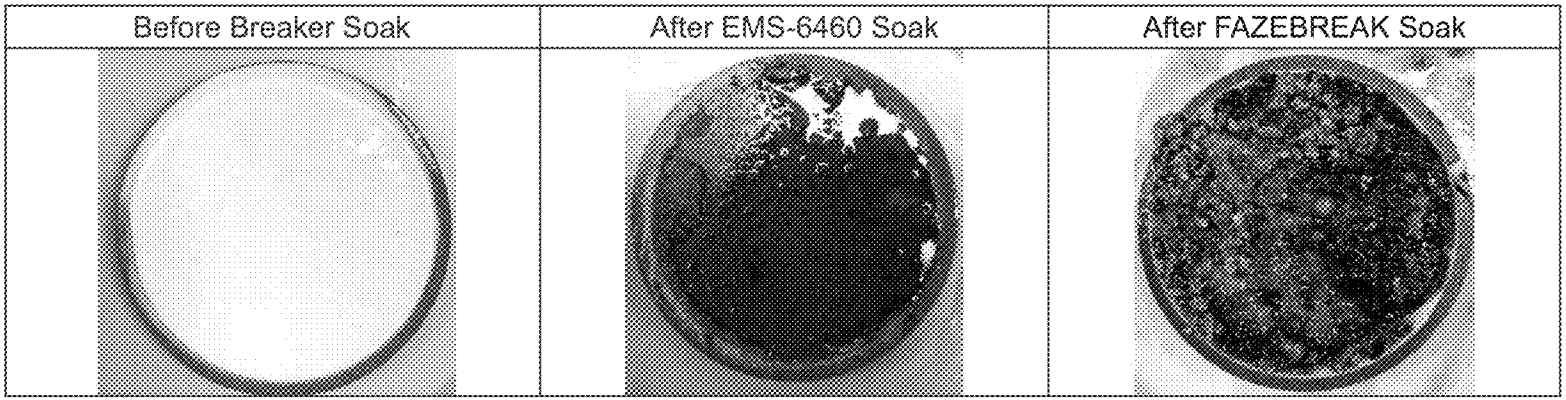
FIG. 3 illustrates residual filter cakes after breaker soak, according to one or more examples of the disclosure.

The results indicated that FAZEBREAK Breaker may not be the right candidate for the testing conditions. There were some precipitates coming out from the reaction between FAZEBREAK and the filter cake due to the limited amount of water in the formulation. It should be noted here that D-SOLVER EXTRA concentration was double (~60% by vol) in the formulation compared to typical breaker formulation due to the design consideration, which resulted in limited amount of water available to keep the reaction byproducts in solution. Therefore, FAZEBREAK breaker was dropped and EMS-6460 was taken for the further testing. FIG. 3 shows images of the residual filter cake associated with the breaker test of Phase-1, wherein the residual filter cake before the beaker soak is the image on the lefthand-side of FIG. 3, the residual filter cake after the EMS-6460 soak is the middle image of FIG. 3, and the residual filter cake after the FAZEBREAK soak is the image on the righthand-side of FIG. 3.

Phase-2: Breaker Test

The focus of the Phase-2 testing was to evaluate the impact of gravel pack saturated with PrimoPAC GPCF on the breaker performance and benchmarked the performance against the return to flow test without breaker application. The formulation of EMS-6460 was slightly adjusted and is shown in Table 10.

Figure 4:
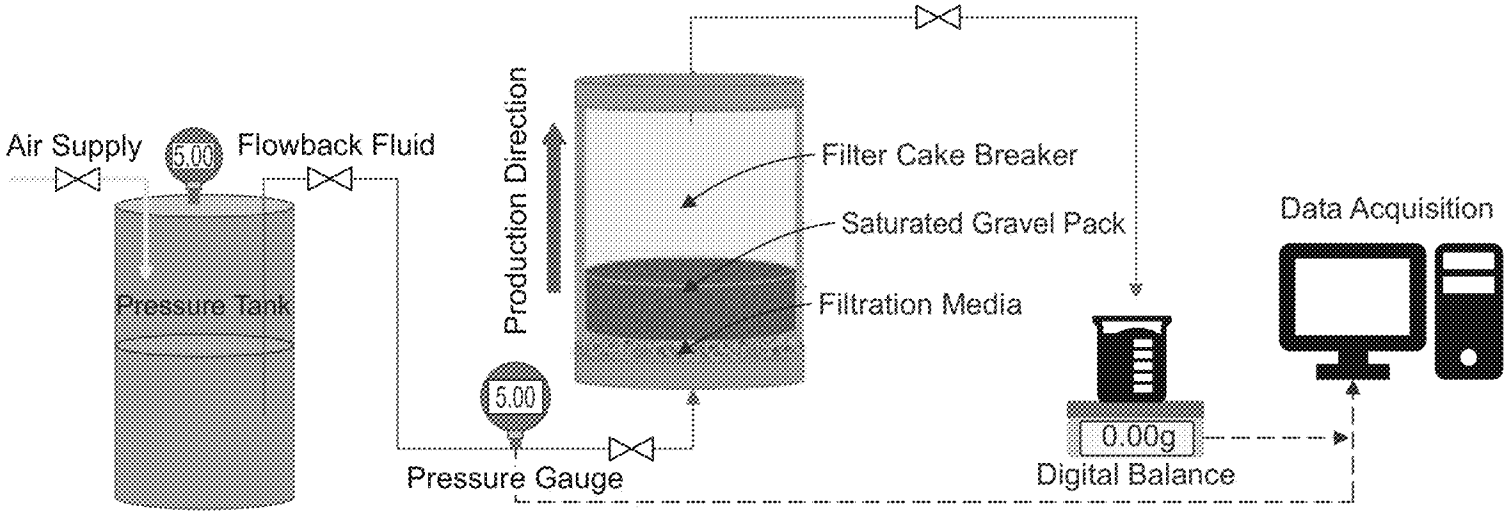
FIG. 4 is a schematic of a flowback tester usable for evaluations of beakers, according to one or more examples of the disclosure.

The testing procedure was modified accordingly as follows:

Initial flow properties of the aloxite disks (API-40) with gravel pack were taken with Flowback Tester (see FIG. 4);

Proppants used for the testing was 20/40 Carboprop™.

1.31 SG PRIMOFAZE RDIF was used to build the 4-hour filter cake under 500 psi differential and 140° C.;

The breakers and PrimoPAC GPCF were mixed and spotted in the calculated volume ratio. It should be noted that PrimoPAC GPCF is non-reversible in Phase-2 testing;

Volume of Breaker=55 mL;

Volume of GPCF=15 mL; and

Amount of Proppants=100 g; and

The breakthrough was monitored. After breakthrough, the filter cakes were soaked with breakers and GPCF for 7 days;

The cells were cooled down and final flow properties were taken for comparison with the initial flow properties; and The HTHP cells were opened and the filter cake residues were inspected. Photos were taken.

TABLE 10

EMS-6460 Breaker Used in Phase-2

| Filter Cake Breaker System | | EMS-6460 | | |
|---|---|---|---|---|
| Final System Density | SG | 1.33 | | |
| Final Brine Density | SG | 1.40 | | |
| | | Concentration | | |
| Products | SG | lb/bbl | kg/m³ | vol/vol |
| 14.2 ppg CaBr2 | 1.700 | 254.32 | 726.59 | 0.427 |
| Water | 1.000 | 112.07 | 320.18 | 0.320 |
| SAFE-VIS E | 0.960 | 5.00 | 14.29 | 0.015 |
| D-GRADE | 1.240 | 70.00 | 199.99 | 0.161 |
| PEN-8 | 0.920 | 23.00 | 65.71 | 0.071 |
| FLOW-BAK | 1.000 | 0.40 | 1.14 | 0.001 |

Figure 5:
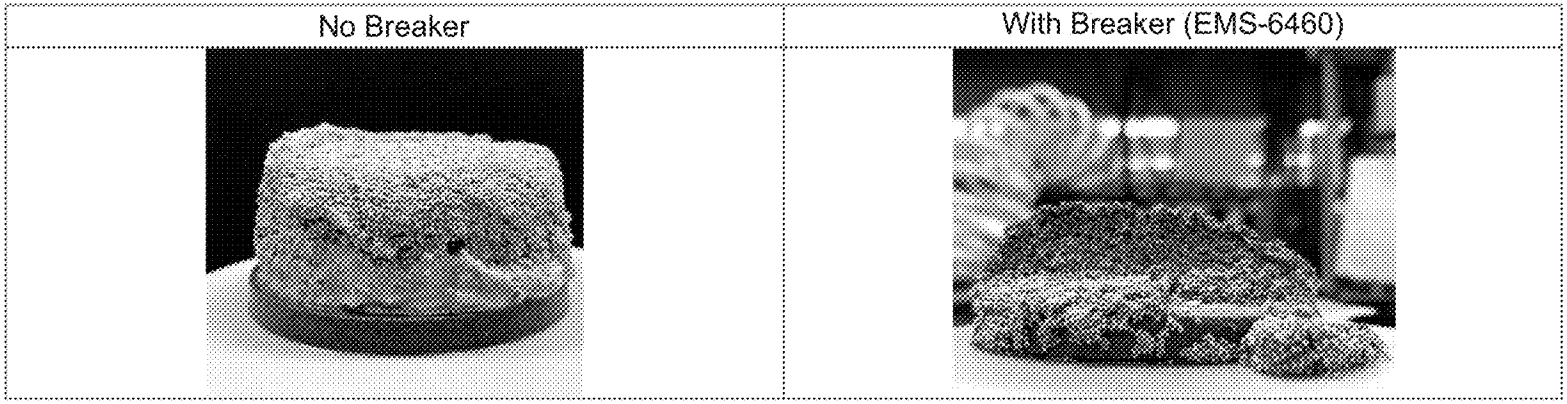
FIG. 5 illustrates residual filter cakes, disks, and gravel packs, according to one or more examples of the disclosure.
Figure 8:
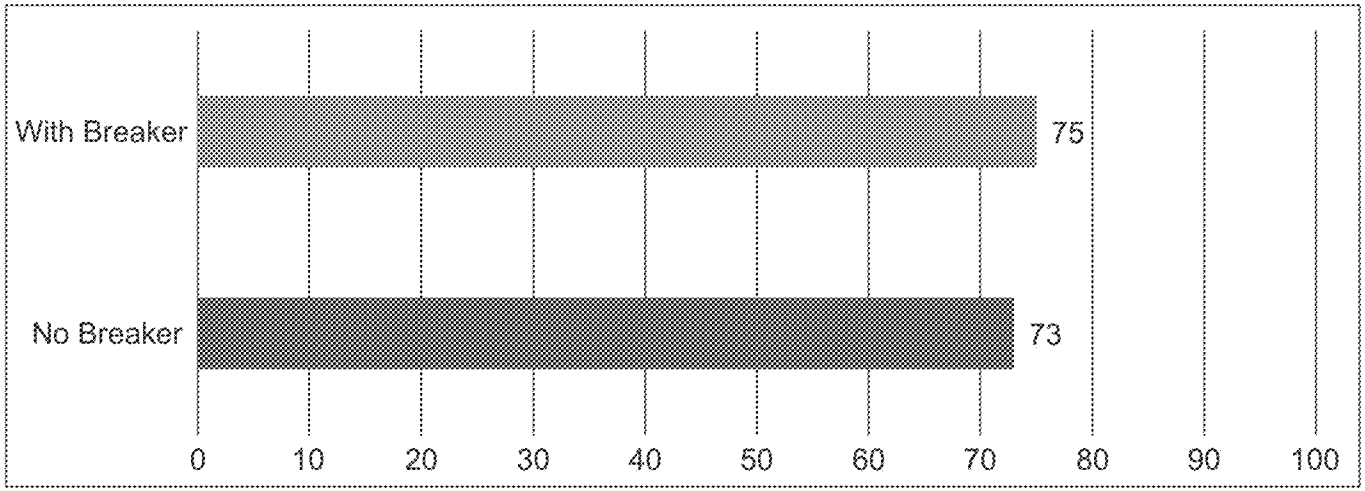
FIG. 8 is a graph illustrating returns to flow percentage in phase-2, according to one or more examples of the disclosure.

In an embodiment, the Flowback Tester has the configuration and structural relationships as shown in FIG. 4. Phase-2 indicated that breaker was struggling to reach to the filter cake indicated by the depth of penetration observed in FIG. 5 and the marginal increase in the return to flow percentage shown in FIG. 8. It was concluded that the migration was largely inhibited by the oil-wet state of IEGPCF. The reversible IEGPCF has not been investigated with the filter cake breaker before. In the next phase of breaker testing, unconventional approaches were taken to improve the breaker performance with the reversible IEGPC.

Phase-3: Break Test

In Phase-3, two unconventional measures were taken to improve the migration of the breaker through the IEGPCF saturated gravel pack. The first measure was to adopt the reversibility property of PRIMOFAZE/FAZEPRO RDIF into the reversible IEGPCF, which would allow the reversible IEGPCF to revert to a water-wet state for the easier diffusion of the breaker through the gravel-pack. The second approach was to pump the degradable polyester particles along with the gravel to attack the reversible IEGPCF from inside. This concept not only promotes the migration of the breaker, but it also behaves as the in-situ breaker, which aids in the removal of the filter cake.

Figure 9:
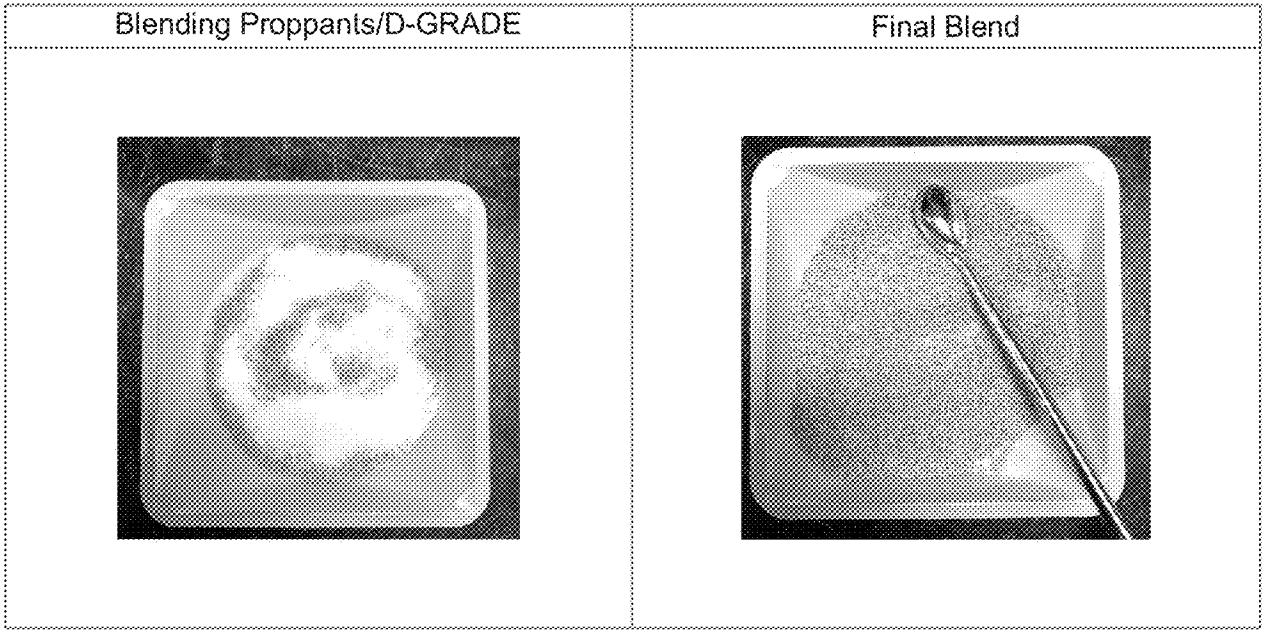
FIG. 9 illustrates blending stages of degradable polyester particles with gravels or proppants, according to one or more examples of the disclosure.

The testing protocol was the same as Phase-2 except that degradable polyester particles were blended as part of the gravel pack in Test #2 and Test #4. FIG. 9 shows the final blend of gravel and D-GRADE. The concentration of D-GRADE is 5% by weight of the gravel loading.

Figure 10:
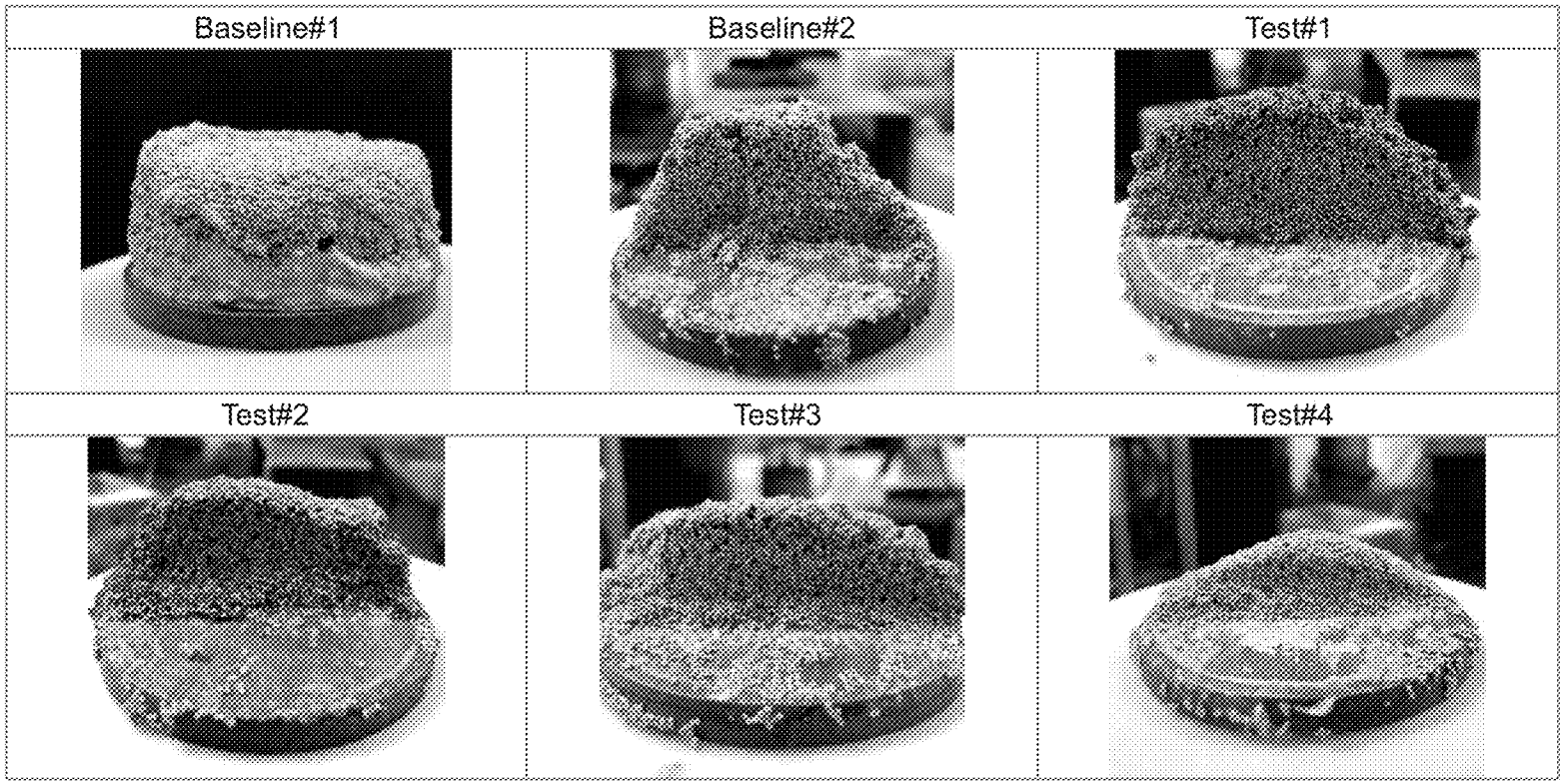
FIG. 10 illustrates residual filter cakes at the end of tests in Phase-3, according to one or more examples of the disclosure.

Table 11 covers the formulation of breakers tested in Phase-3 test (see FIG. 10). Reversible IEGPCF was used to saturate the gravel pack in all the tests.

No post-gravel pack breaker with no degradable polyester particles in the gravel pack from Phase-2 served as the Baseline #1. No post-gravel pack breaker with degradable polyester particles in the gravel pack test was performed as the Baseline #2. The degradable polyester particles was blended with the gravel as in-situ breaker.

Test #1 and #2 utilized the same breaker system (EMS-6460) from Phase-2 with slight changes. Test #1 had no degradable polyester particles in the gravel pack, but it was blended with gravel in Test #2.

D-STRUCTOR was included in the breaker formulation in Test #3 and #4. Due to its liquid state, D-STRUCTOR was determined to be a better candidate for the gravel pack scenario. Degradable polyester particles were either blended with the gravel or with the breaker. Test #3 had no degradable polyester particles in the gravel pack, but it was mixed in the breaker. Test #4 had degradable polyester particles in the gravel pack, and therefore it was removed from the breaker. The breaker system with D-STRUCTOR is commercially named FAZEOUT™.

Figure 11:
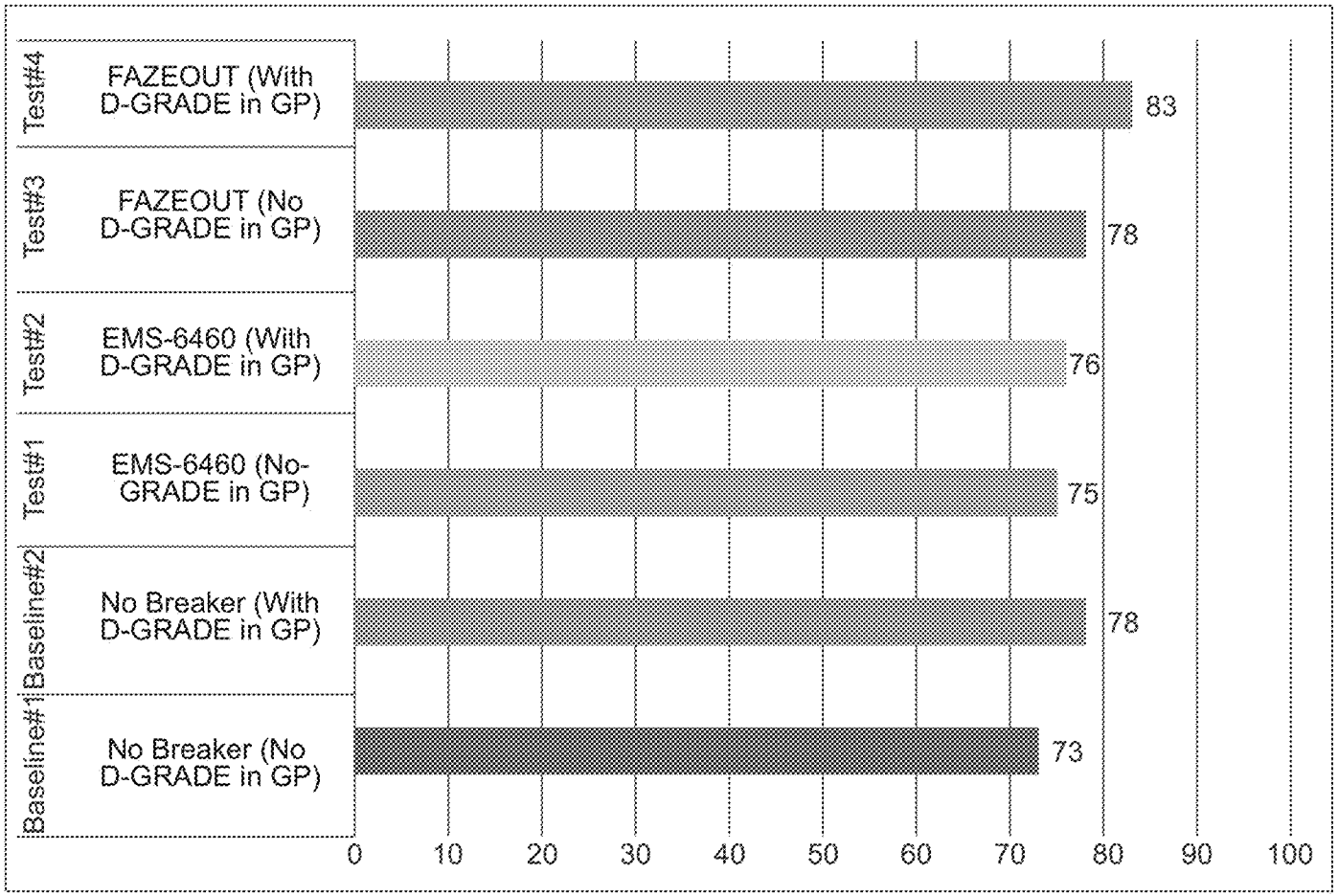
FIG. 11 is a graph illustrating returns to flow percentage, according to one or more examples of the disclosure.

As shown in FIG. 11, the return flow percentages of Tests #1-#4 are shown in comparison with baseline tests #1 and #2. The highest improvement over the baseline tests was seen in Test #4 by 10% where the degradable polyester particles were blended with the gravels and the breaker system is FAZEOUT.

The second highest return to flow percentage was achieved in Baseline #2 and Test #3 with 78% respectively. This proved that blending degradable polyester particles with gravels not only breaks down the reversible IEGPCF but also attack the filter cake to a certain extent.

Performance testing with respect to the infused proppants was also completed for two samples (i.e., 1$^{st}$ Sample and 2$^{nd}$ Sample). The 1$^{st}$ Sample is a known infused proppant that is commercially available from Carbo Ceramics, Inc. (Houston, TX) and the 2$^{nd}$ Sample is the infused proppant according to the present disclosure, wherein the degradable polyester disclosed herein has been infused into the proppant. The performance testing parameters and results follow:

TABLE 11

Formulations of Breaker Tested in Phase-3

| Test No | | 1 | | | 2 | | | 3 | | | 4 | | |
|---|---|---|---|---|---|---|---|---|---|---|---|---|---|
| Breaker System | | EMS-6460 | | | EMS-6460 | | | FAZEOUT | | | FAZEOUT | | |
| Weight of Gravel | g | 100 | | | 100 | | | 100 | | | 100 | | |
| D-GRADE in GP | g | 0 | | | 5 | | | 0 | | | 5 | | |
| Products | SG | Concentration | | | Concentration | | | Concentration | | | Concentration | | |
| | | lb/bbl | kg/m$^3$ | vol/vol | lb/bbl | kg/m$^3$ | vol/vol | lb/bbl | kg/m$^3$ | vol/vol | lb/bbl | kg/m$^3$ | vol/vol |
| 14.2 lb/gal CaBr2 | 1.700 | 235.26 | 672.14 | 0.395 | 235.26 | 672.14 | 0.395 | 218.07 | 623.03 | 0.367 | 229.77 | 656.45 | 0.386 |
| Water | 1.000 | 87.32 | 249.47 | 0.249 | 87.32 | 249.47 | 0.249 | 84.52 | 241.47 | 0.241 | 97.81 | 279.44 | 0.279 |
| D-GRADE | 1.240 | 80.00 | 228.56 | 0.184 | 80.00 | 228.56 | 0.184 | 30.00 | | | | | |
| D-SOLVER EXTRA | 1.200 | | | | | | | 10.00 | 28.57 | 0.024 | 10.00 | 28.57 | 0.024 |
| D-STRUCTOR | 1.150 | | | | | | | 100.00 | 285.70 | 0.248 | 100.00 | 285.70 | 0.248 |
| DEEPCLEAN | 0.920 | 55.00 | 157.14 | 0.171 | 55.00 | 157.14 | 0.171 | 20.00 | 57.14 | 0.062 | 20.00 | 57.14 | 0.062 |
| FLOW-BAK | 1.080 | 0.40 | 1.14 | 0.001 | 0.40 | 1.14 | 0.001 | 0.40 | 1.14 | 0.001 | 0.40 | 1.14 | 0.001 |
| A-272 | 1.000 | 5.00 | 14.29 | 0.014 | 5.00 | 14.29 | 0.014 | 5.00 | 14.29 | 0.014 | 5.00 | 14.29 | 0.014 |
| Base Brine density | SG | | 1.43 | | | 1.43 | | | 1.42 | | | 1.41 | |
| Breaker Density | SG | | 1.31 | | | 1.31 | | | 1.31 | | | 1.31 | |

TABLE 12

Summary of Phase-3 Breaker Test Results

| Test No | | Baseline-1 | Baseline-2 | 1 | 2 | 3 | 4 |
|---|---|---|---|---|---|---|---|
| Breaker System | | No | No | EMS-6460 | EMS-6460 | FAZEOUT | FAZEOUT |
| Weight of Gravel | g | 100 | 100 | 100 | 100 | 100 | 100 |
| D-GRADE in GP | g | 0 | 5 | 0 | 5 | 0 | 5 |
| Delay Period | hrs | — | >4 & <24 | >4 | 3.5 | 3.0 | 3.5 |
| Return Flow % | % | 73 | 78 | 75 | 76 | 78 | 83 |

For the 1$^{st}$ Sample:

Temperatures:

250° F. (121° C.)=Middle point between the hottest and coolest reservoir.

Gravels Type:

16/20 POM infused proppants ("POM"); and

16/20 Carbolite™ proppants ("CL").

Fluid Compositions and pH @ Room Temp:

Tap Water=7.3;

5% v HCl=0.8; and

30% v D-STRUCTOR=3.4.

Test Setup:

25 mL graduated cylinders were used for the test;

Each gravel type was weighed for 15 mL in the graduated cylinders;

Fill up the graduated cylinders with respective fluid (Tap Water, 5% v HCl and 30% D-S);

Measure the initial pH and static aged in the oven at 250° F. (121° C.); and

Measure pH after 24 hrs, 48 hrs, and 6 days.

Figure 12:
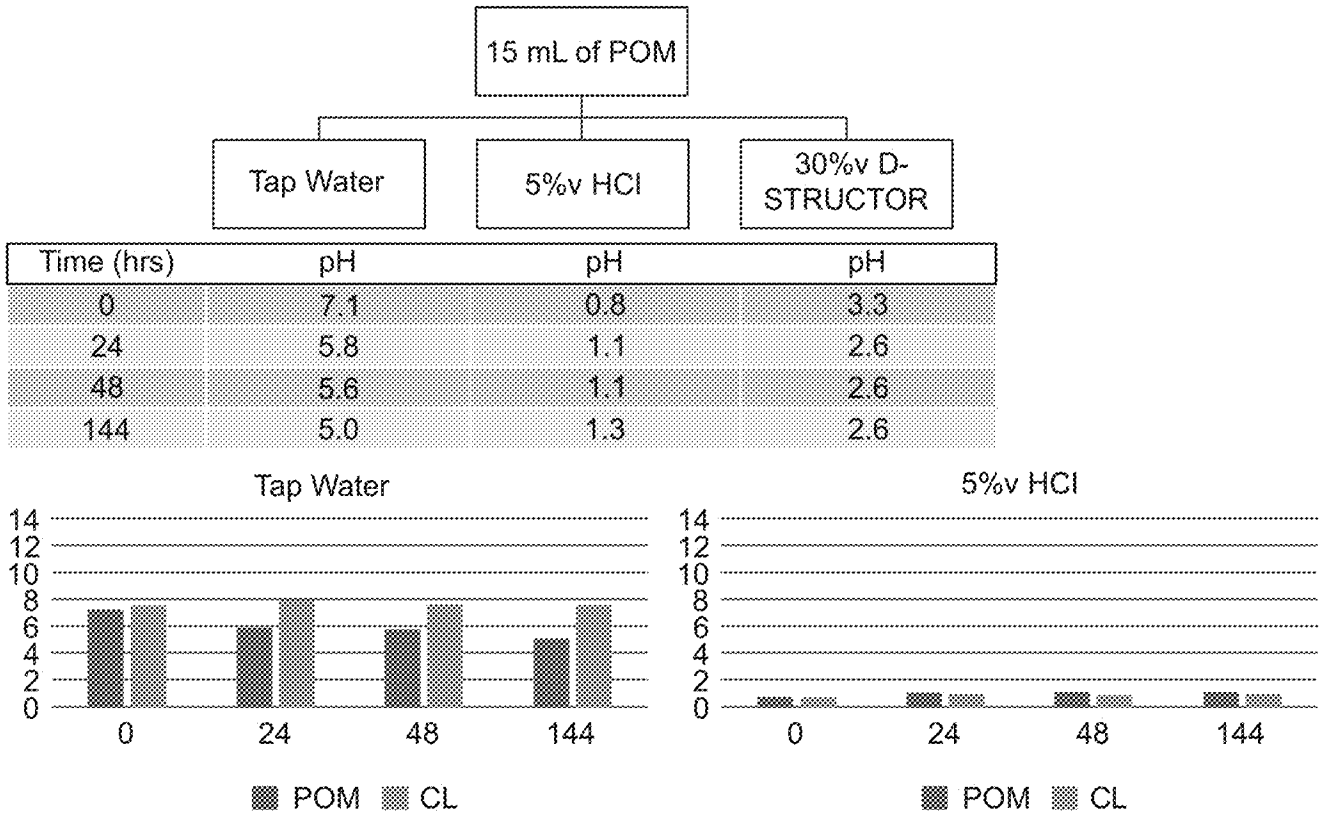
FIG. 12 comprises charts and graphs of samples with respect to pH values and time durations, according to one or more examples of the disclosure.
Figure 12:
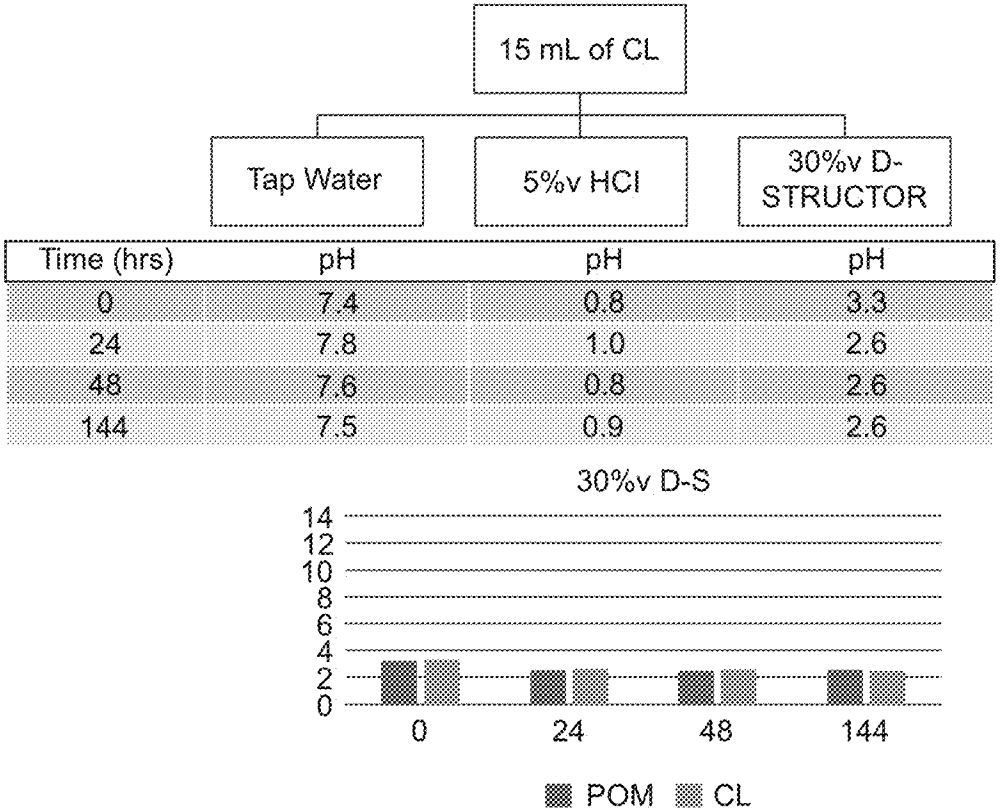

Experimental data collected during the performance testing with respect to the 1st Sample is set forth in tables and graphs set forth in FIG. 12. The experimental data shows that in some embodiments: the measured pH values for CL in tap water may be the same as, greater than or substantially greater than the measure pH values for POM in tap water; the measured pH values for POM in 5% v HCl may be about the same as or substantially the same as the measured pH values for CL in 5% v HCl; and the measured pH values for POM in 30% v D-STRUCTOR may be about the same as or substantially the same as the measure pH values for CL in 30% v D-STRUCTOR.

For the 2nd Sample:

Temperatures:

About 250° F. (about 121° C.)=Middle point between the hottest and coolest reservoir.

Gravels Type:

30/40 D-GRADE infused proppants.

Fluid Compositions and pH @ Room Temp:

Tap Water=about 7.3.

Test Setup:

About 25 mL graduated cylinders were used for the test.

Each gravel type was weighed for about 15 mL in the graduated cylinders.

Fill up the graduated cylinders with respective fluid (Tap Water).

Measure the initial pH and static aged in the oven at about 250° F.

Measure pH after about 2 hrs, about 4 hrs, about 8 hrs, about 16 hrs, about 24 hrs, and about 48 hrs.

Figure 13:
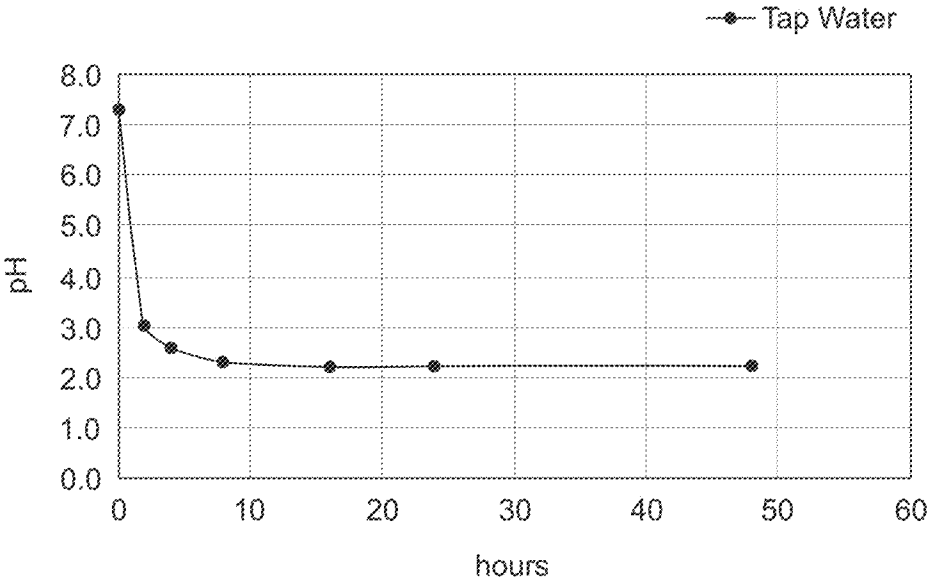
FIG. 13 comprises a chart and graph for hydrolysis of infused proppants disclosed herein, according to one or more examples of the disclosure.

As shown in FIG. 13, the hydrolysis of the novel infused proppants disclosed herein and utilized in the 2nd Sample was indicated by the downward trend in pH and the pH plateaued at about 2.2 after about 8 hours exposure at about 250° F. (about 121° C.).

For the stability/stress test of the novel degradable polyester particles and the novel reversible IEGPCF according to the present disclosure:

Temperatures:

Hottest well→The simulated BHCT during GP pumping for avg BHST of about 285° F. and about 200 m OH length was about 230° F.

Fluid Composition with Conventional Proppants:

Volume of GPCF=about 300 mL equivalent to about 0.86 bbl;

Gravel Loading=about 2 ppa→about 72 g for about 300 mL of fluid; and

Degradable polyester/acid precursor loading=about 5% wt. of gravel loading→about 3.6 g for about 300 mL of fluid.

Figure 14:
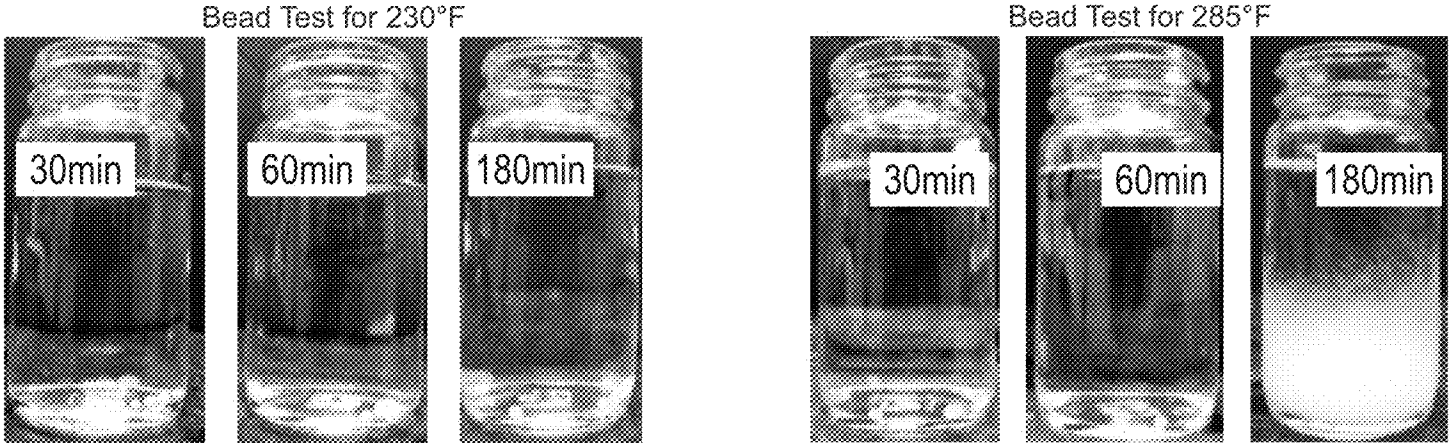
FIG. 14 comprises a chart and graph for at least one bead test, according to one or more examples of the disclosure.

Test Setup:

Oven Temp is pre-heated to the test temperatures of about 230° F. and about 285° F.;

The fluid/gravel/acid precursor mixtures are loaded into the aging cells;

One cell for each exposure time of about 30 min, about 60 min, and about 180 min;

Time is counted from the time the cell is put inside the oven until it is taken out;

Each cell was cooled by fan for about 30 mins before opening;

The fluid/gravel/acid precursor mixtures are then remixed under slow shear for about 5 mins before taking ES measurements; and Pictures of the bead test are shown in FIG. 14.

For the stability/stress test of the novel 2nd Sample and the novel reversible IEGPCF according to the present disclosure:

Temperatures:

Hottest well→The simulated BHCT during GP pumping for avg BHST of about 285° F. and about 200 m OH length is about 230° F.

Fluid Composition with Conventional Proppants+the novel Infused Proppants according to the present disclosure:

Volume of GPCF=about 300 mL equivalent to about 0.86 bbl;

Gravel Loading=about 2 ppa→about 72 g for about 300 mL of fluid→about 36 g of 20/40+about 36 g of novel infused proppants; and Theoretical degradable polyester/acid precursor loading=about 5% wt. of gravel loading→about 3.6 g for about 300 mL of fluid.

Figure 15:
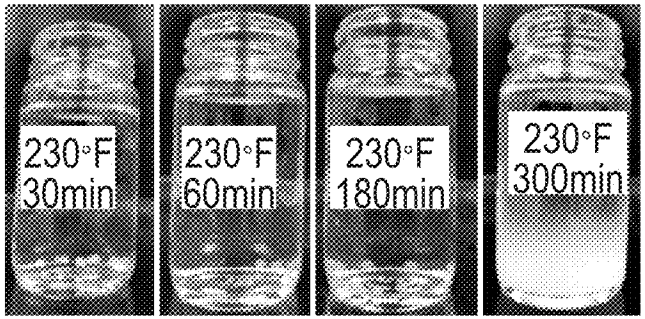
FIG. 15 comprises a chart and graph for at least one bead test, according to one or more examples of the disclosure.
Figure 15:
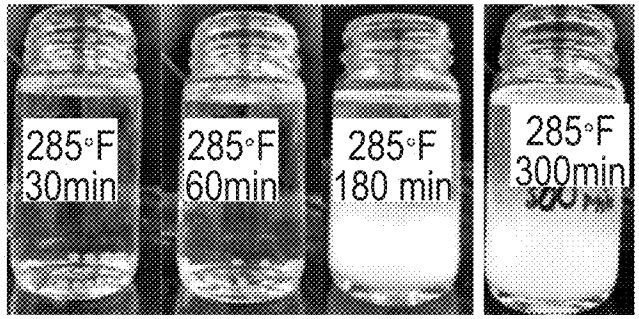

Test Setup:

Oven Temp is pre-heated to the test temperatures of about 230° F. and about 285° F.;

The fluid/gravel/acid precursor mixtures are loaded into the aging cells;

One cell for each exposure time of about 30 min, about 60 min, about 180 min, and about 300 min;

Time is counted from the time the cell is put inside the oven until it is taken out;

Each cell was cooled by fan for about 30 mins before opening;

The fluid/gravel/acid precursor mixtures are then remixed under slow shear for about 5 mins before taking ES measurements; and Pictures of the bead test are shown in FIG. 15.

The foregoing description, for purposes of explanation, used specific nomenclature to provide a thorough understanding of the disclosure. However, it will be apparent to one skilled in the art that the specific details are not required in order to practice the systems and methods described herein. The foregoing descriptions of specific examples are presented for purposes of illustration and description. They are not intended to be exhaustive of or to limit this disclosure to the precise forms described. Obviously, many modifications and variations are possible in view of the above teachings. The examples are shown and described in order to best explain the principles of this disclosure and practical applications, to thereby enable others skilled in the art to best utilize this disclosure and various examples with various modifications as are suited to the particular use contemplated. It is intended that the scope of this disclosure be defined by the claims and their equivalents below.

What is claimed is:

1. A method comprising:

drilling an interval of a wellbore with a non-aqueous wellbore fluid, wherein the interval of the wellbore traverses a subterranean formation, and wherein the non-aqueous wellbore fluid produces a filter cake in the interval of the wellbore;

gravel packing the interval of the wellbore with a gravel pack that includes a non-aqueous gravel pack carrier fluid, proppants, and degradable polyester particles, wherein at least a portion of the proppants have a specific gravity of about 2.0 and are coated with a degradable polyester coating, and wherein the degradable polyester particles are present at about 5% by weight of the proppants;

introducing a filter cake breaker fluid system into the wellbore, wherein the filter cake breaker fluid system includes a degradable polyester;

hydrolyzing the degradable polyester of the filter cake breaker fluid system to decrease the pH of the gravel pack and cause the non-aqueous gravel pack carrier fluid to revert to a water-wet state; and degrading, using the filter cake breaker fluid system and after the non-aqueous gravel pack carrier fluid has reverted to the water-wet state, at least a portion of the filter cake.

2. The method of claim 1, further comprising:

adding the degradable polyester particles to the gravel pack prior to gravel packing the interval of the wellbore, wherein the degradable polyester particles include the degradable polyester.

3. The method of claim 1, wherein at least a second portion of the proppants is infused with the degradable polyester.

4. The method of claim 1, wherein the non-aqueous gravel pack carrier fluid is a reversible invert emulsion fluid.

5. The method of claim 1, wherein an organic acid is releasable from the degradable polyester to decrease the pH of the gravel pack to a pH value that is less than 5.

6. The method of claim 1, wherein an organic acid is releasable from the degradable polyester, the organic acid selected from the group consisting of polylactic acid, polyglycolic acid, polylactic-co-glycolic acid, polymalic acid, polygluconic acid, poly citric acid, poly mandelic acid, polysaccharide acid, poly mucic acid, and poly tartaric acid.

7. The method of claim 1, further comprising releasing an organic acid, wherein the organic acid includes polylactic acid or polylactic-co-glycolic acid.

8. The method of claim 1, wherein the lower wherein hydrolyzing the degradable polyester of the filter cake breaker fluid system decreases the pH of the gravel pack to a pH value that is less than 5.

9. The method of claim 1, wherein the filter cake breaker fluid system is a delayed filter cake breaker and hydrolyzing the degradable polyester of the filter cake breaker fluid system releases acidic byproducts over a period of time.

10. A method comprising:

running a sand control screen assembly to a selected depth within an uncased section of a wellbore to facilitate a gravel packing operation;

introducing a gravel pack slurry into the wellbore to facilitate the gravel packing operation, the gravel pack slurry including a non-aqueous gravel pack carrier fluid, proppants, and degradable polyester particles, wherein at least a portion of the proppants have a specific gravity of about 2.0 and are coated with a degradable polyester coating, and wherein the degradable polyester particles are present at about 5% by weight of the proppants;

introducing a filter cake breaker fluid system into the wellbore, wherein the filter cake breaker fluid system includes a degradable polyester;

hydrolyzing the degradable polyester of the filter cake breaker fluid system to decrease the pH of a gravel pack formed from the gravel pack slurry and cause the non-aqueous gravel pack carrier fluid to revert to a water-wet state; and degrading, using the filter cake breaker fluid system and after reverting the non-aqueous gravel pack carrier fluid to the water-wet state, at least a portion of a filter cake disposed in the wellbore.

11. The method of claim 10, wherein the degradable polyester is in the form of sized degradable polyester particles.

12. The method of claim 10, wherein the degradable polyester is infused into at least a second portion of the proppants.

13. The method of claim 10, wherein the non-aqueous gravel pack carrier fluid is a reversible invert emulsion fluid.

14. The method of claim 10, wherein hydrolyzing the degradable polyester of the filter cake breaker fluid system decreases the pH of the gravel pack to a pH value that is between 1 and 5.

15. The method of claim 10, wherein an organic acid is releasable from the degradable polyester, the organic acid selected from the group consisting of polylactic acid, polyglycolic acid, polylactic-co-glycolic acid, polymalic acid, polygluconic acid, poly citric acid, poly mandelic acid, polysaccharide acid, poly mucic acid, and poly tartaric acid.

16. A system for degrading a filter cake in a wellbore, the system, comprising:

a gravel pack system configured for gravel packing an interval of a wellbore traversing a subterranean formation, the gravel pack system comprising:

a reversible invert emulsion gravel pack carrier fluid that includes an alkaline agent, an amine as a primary emulsifier, and a tall-oil fatty acid as a secondary emulsifier;

a plurality of proppants; and degradable polyester particles, wherein at least a portion of the plurality of proppants have a specific gravity of about 2.0 and are coated with a degradable polyester coating, and wherein the degradable polyester particles are present at about 5% by weight of the plurality of proppants; and a filter cake breaker system configured to be introduced into the wellbore after the gravel packing to degrade a filter cake, the filter cake breaker system comprising:

wellbore fluids; and degradable polyester contained within the wellbore fluids, the degradable polyester configured to hydrolyze to decrease the pH of the gravel pack system and cause the reversible invert emulsion gravel pack carrier fluid to revert to a water-wet state, wherein the filter cake breaker system is configured to degrade at least a portion of the filter cake after the reversible invert emulsion gravel pack carrier fluid reverts to the water-wet state.

17. The system of claim 16, wherein the degradable polyester is in the form of sized degradable polyester particles.

18. The system of claim 16, wherein the filter cake breaker system further comprises a degradable polymeric breaker and a degradable polyester particle, both contained within the wellbore fluids.

19. The system of claim 16, wherein the filter cake breaker system is a delayed filter cake breaker that releases acidic byproducts that degrade acid-soluble components in the filter cake over a period of time.

20. The system of claim 16, wherein the degradable polyester comprises an organic acid precursor.

* * * * *